US010813806B2

(12) United States Patent
Paul

(10) Patent No.: US 10,813,806 B2
(45) Date of Patent: Oct. 27, 2020

(54) MEDICAL SUPPORT APPARATUS WITH STAND ASSISTANCE

(71) Applicant: Stryker Corporation, Kalamazoo, MI (US)

(72) Inventor: Anish Paul, Portage, MI (US)

(73) Assignee: Stryker Corporation, Kalamazoo, MI (US)

( * ) Notice: Subject to any disclaimer, the term of this patent is extended or adjusted under 35 U.S.C. 154(b) by 190 days.

(21) Appl. No.: 15/602,558

(22) Filed: May 23, 2017

(65) Prior Publication Data

US 2017/0340495 A1 Nov. 30, 2017

Related U.S. Application Data

(60) Provisional application No. 62/340,694, filed on May 24, 2016.

(51) Int. Cl.
*A61G 5/14* (2006.01)
*A61G 5/12* (2006.01)
(Continued)

(52) U.S. Cl.
CPC ..... *A61G 5/14* (2013.01); *A61G 5/04* (2013.01); *A61G 5/1013* (2013.01); *A61G 5/122* (2016.11);
(Continued)

(58) Field of Classification Search
CPC ..... A61G 5/14; A61G 5/125; A61G 5/122; A61G 5/127; A61G 5/04; A61G 5/1013;
(Continued)

(56) References Cited

U.S. PATENT DOCUMENTS 1,025,915 A * 5/1912 Hoff ..... A47C 7/56 248/396
2,587,068 A 2/1952 Sanders
(Continued)

FOREIGN PATENT DOCUMENTS

AU 1742699 A 5/1999
AU 199917426 6/1999
(Continued)

OTHER PUBLICATIONS

Machine translation of foreign reference JP2010154929, obtained from https://www4.j-platpat.inpit.go.jp/cgi-bin/tran_web_cgi_ejje?u =http://www4.j-platpat.inpit.go.jp/eng/translation/20190315060138152697577230580164 01FBF100ADC89BAFF269824D410A0495B (last accessed on Mar. 14, 2019) (Year: 2019).*
(Continued)

*Primary Examiner* — Theodore V Adamos
(74) *Attorney, Agent, or Firm* — Warner Norcross + Judd LLP

(57) ABSTRACT

A chair includes a control system for moving the chair between seated and standing configurations to thereby help facility an occupant's egress out of, or ingress into, the chair. One or more controls are provided on the chair that enable the occupant to control the timing of when the chair's movement between the configurations starts, what speed the chair moves at, and when the chair stops. A caregiver control panel provides the caregiver with multiple options for dictating what aspects of the chair's movement between the configurations the occupant is able to control. In some embodiments, a controller dynamically adjusts the speed of the chair based on shifts in the occupant's weight during the transition between the standing and seated configurations, as detected by one or more force sensors. The force sensors
(Continued)

may be integrated into the armrests, the seat, the backrest, a combination of these, or elsewhere.

20 Claims, 9 Drawing Sheets

(51) Int. Cl.
*A61G 5/04* (2013.01)
*A61G 5/10* (2006.01)

(52) U.S. Cl.
CPC ..... *A61G 5/125* (2016.11); *A61G 5/127* (2016.11); *A61G 2203/10* (2013.01); *A61G 2203/16* (2013.01); *A61G 2203/30* (2013.01); *A61G 2203/32* (2013.01); *A61G 2203/40* (2013.01)

(58) Field of Classification Search
CPC ..... A61G 5/104; A61G 2203/32; A61G 2203/10; A61G 2203/16; A61G 2203/30; A61G 2203/40
See application file for complete search history.

(56) References Cited

U.S. PATENT DOCUMENTS 3,091,426 A 5/1963 Bogart
3,191,196 A 6/1965 Holm
3,578,379 A 5/1971 Taylor et al.
3,640,566 A 2/1972 Hodge
3,787,089 A 1/1974 Wrethander
3,936,893 A 2/1976 Anderson et al.
4,119,342 A 10/1978 Jones
4,183,578 A 1/1980 Naganawa
4,850,645 A 7/1989 Crockett
4,913,264 A 4/1990 Voves et al.
4,997,200 A 3/1991 Earls
5,062,151 A 10/1991 Shipley
5,112,076 A 5/1992 Wilson
5,219,204 A 6/1993 Bathrick et al.
5,230,113 A 7/1993 Foster et al.
5,242,138 A 9/1993 Kornberg
5,265,935 A 11/1993 Geisler et al.
5,342,114 A 8/1994 Burke et al.
5,346,280 A 9/1994 Deumite
5,366,036 A 11/1994 Perry
5,419,571 A 5/1995 Vaughan
5,458,349 A 10/1995 Mung-Tung
5,515,561 A 5/1996 Suggitt et al.
5,547,245 A 8/1996 Knouse
5,556,121 A 9/1996 Pillot
5,641,201 A 6/1997 Casey et al.
5,699,038 A 12/1997 Ulrich et al.
5,772,226 A 6/1998 Bobichon
5,896,602 A 4/1999 Marblestone
5,917,425 A 6/1999 Crimmins et al.
5,984,411 A 11/1999 Galumbeck
6,017,354 A 1/2000 Culp et al.
6,024,411 A 2/2000 Pesta et al.
6,053,578 A 4/2000 van Hekken et al.
6,142,568 A 11/2000 Abelbeck et al.
6,161,229 A 12/2000 Ryan et al.
6,296,313 B1 10/2001 Wu
6,338,531 B1 1/2002 Hausherr et al.
6,454,285 B1 9/2002 Koenig
6,533,304 B2 3/2003 Lizama-Troncoso et al.
6,533,353 B2 3/2003 Johnston
6,540,250 B1 4/2003 Peterson
6,557,940 B2 5/2003 Hayashi et al.
6,594,837 B2 7/2003 Khait
6,612,985 B2 9/2003 Eiffert et al.
6,701,546 B2 3/2004 Hodgetts
6,715,784 B2 4/2004 Koerlin et al.
6,792,633 B1 9/2004 Ito
6,886,194 B2 5/2005 Hodgetts
6,907,630 B2 6/2005 Treon
7,003,830 B2 2/2006 Ito
7,007,963 B2 3/2006 Meyer
7,021,713 B2 4/2006 Kao et al.
7,058,999 B2 6/2006 Horitani et al.
7,090,297 B2 8/2006 Mohn et al.
7,100,242 B2 9/2006 Maierholzner
7,219,912 B2 5/2007 Meyer
7,284,799 B2 10/2007 Chung
7,398,571 B2 7/2008 Souke et al.
7,399,205 B2 7/2008 McNeely et al.
7,410,055 B2 8/2008 Plank
7,419,176 B2 9/2008 Perk
7,455,360 B2 11/2008 White et al.
7,458,119 B2 12/2008 Hornbach et al.
7,472,438 B2 1/2009 Karmer, Jr. et al.
7,570,152 B2 8/2009 Smith et al.
7,631,937 B2 12/2009 Robertson
7,638,958 B2 12/2009 Philipp et al.
7,708,093 B1 5/2010 Baker
7,725,968 B2 6/2010 Lambarth
7,746,218 B2 6/2010 Collins, Jr. et al.
7,815,209 B2 10/2010 Porcheron
7,862,123 B2 1/2011 Baker et al.
7,874,620 B2 1/2011 Kooistra et al.
7,887,133 B2 2/2011 Perk
7,896,442 B2 3/2011 White
7,899,006 B2 3/2011 Boyd
7,979,931 B2 7/2011 Wurdeman
8,056,160 B2 * 11/2011 Poulos ..... A61G 7/005 5/424
8,065,024 B2 11/2011 Nagaoka et al.
8,069,514 B2 12/2011 Poulos et al.
8,104,118 B2 1/2012 Derenne et al.
8,123,664 B2 2/2012 Lokken et al.
8,127,380 B2 3/2012 Wurdeman
8,128,120 B2 3/2012 Porcheron
8,272,087 B2 9/2012 Westermann
8,319,633 B2 11/2012 Becker et al.
8,334,779 B2 12/2012 Zerhusen et al.
8,336,133 B2 12/2012 Palay et al.
8,414,074 B2 4/2013 Kramer et al.
8,437,876 B2 5/2013 Receveur et al.
8,439,416 B2 5/2013 Lambarth et al.
8,461,968 B2 6/2013 Ball et al.
8,499,385 B2 8/2013 Horitani
8,516,637 B2 8/2013 Karwal et al.
8,522,379 B2 9/2013 Turner
8,535,342 B2 9/2013 Malackowski et al.
8,544,866 B2 10/2013 Noonan et al.
8,631,524 B2 1/2014 Derenne et al.
8,756,078 B2 6/2014 Collins, Jr. et al.
8,844,078 B2 9/2014 Hornbach et al.
8,856,982 B1 10/2014 Kalivas
8,887,272 B2 11/2014 Urness et al.
8,910,329 B2 12/2014 Turner et al.
8,959,681 B2 2/2015 Richards
9,138,173 B2 9/2015 Penninger et al.
9,259,369 B2 2/2016 Derenne et al.
9,320,444 B2 4/2016 Hayes et al.
9,569,591 B2 2/2017 Vanderpohl, III
2002/0084903 A1 7/2002 Chaco
2002/0145534 A1 10/2002 Dempsey
2002/0167417 A1 11/2002 Welles, II et al.
2002/0183979 A1 12/2002 Wildman
2005/0046129 A1 3/2005 Antonishak et al.
2006/0238007 A1 10/2006 Lin
2007/0089238 A1 4/2007 Kramer et al.
2007/0114828 A1 5/2007 Corcoran
2008/0007103 A1 * 1/2008 Welles ..... A61B 5/11 297/330
2008/0106060 A1 5/2008 Knopf
2008/0242521 A1 10/2008 Einav
2010/0017072 A1 * 1/2010 Emilsson ..... A61G 5/045 701/49
2010/0064439 A1 3/2010 Soltani
2010/0066056 A1 3/2010 Li et al.
2010/0095453 A1 4/2010 Lin et al.

(56) References Cited

U.S. PATENT DOCUMENTS

| | | | | |
|---|---|---|---|---|
| 2010/0186163 | A1 | 7/2010 | Torra Sorribes | |
| 2010/0212087 | A1 | 8/2010 | Leib et al. | |
| 2011/0078113 | A1 | 3/2011 | Franz | |
| 2011/0084529 | A1 | 4/2011 | Huang | |
| 2011/0087113 | A1 | 4/2011 | Mack et al. | |
| 2011/0121625 | A1* | 5/2011 | Lipford | A61G 5/14 297/311 |
| 2011/0168478 | A1* | 7/2011 | Kuo | B60K 26/02 180/315 |
| 2011/0227314 | A1 | 9/2011 | Lowenthal et al. | |
| 2011/0248530 | A1 | 10/2011 | Sartisohn | |
| 2011/0263950 | A1 | 10/2011 | Larson et al. | |
| 2011/0266840 | A1 | 11/2011 | Wu | |
| 2012/0073054 | A1 | 3/2012 | O'Keefe et al. | |
| 2012/0104818 | A1 | 5/2012 | Morris | |
| 2012/0146378 | A1 | 6/2012 | Lokken et al. | |
| 2012/0174319 | A1 | 7/2012 | Menkedick et al. | |
| 2012/0181832 | A1 | 7/2012 | Lin et al. | |
| 2013/0007960 | A1 | 1/2013 | Manouchehri et al. | |
| 2013/0020779 | A1 | 1/2013 | Green et al. | |
| 2013/0026737 | A1 | 1/2013 | Pizzi Spadoni | |
| 2013/0125310 | A1 | 5/2013 | Manouchehri | |
| 2013/0184003 | A1 | 7/2013 | Alizadeh-Shabdiz et al. | |
| 2013/0219622 | A1 | 8/2013 | Hornbach et al. | |
| 2013/0244692 | A1 | 9/2013 | Kelly et al. | |
| 2013/0253291 | A1 | 9/2013 | Dixon et al. | |
| 2014/0007346 | A1 | 1/2014 | Lachenbruch | |
| 2014/0080413 | A1 | 3/2014 | Hayes et al. | |
| 2014/0090171 | A1 | 4/2014 | Hyde et al. | |
| 2014/0115784 | A1 | 5/2014 | Johannigman et al. | |
| 2014/0265497 | A1 | 9/2014 | Hough et al. | |
| 2014/0265500 | A1* | 9/2014 | Hough | A61G 5/14 297/340 |
| 2014/0289959 | A1 | 10/2014 | Hjort et al. | |
| 2014/0296755 | A1 | 10/2014 | Lack et al. | |
| 2014/0297327 | A1 | 10/2014 | Heil et al. | |
| 2014/0310876 | A1* | 10/2014 | Roussy | A61G 7/015 5/613 |
| 2014/0346745 | A1* | 11/2014 | Ganel | A61G 5/1002 280/47.4 |
| 2015/0060162 | A1* | 3/2015 | Goffer | A61G 5/12 180/41 |
| 2015/0081335 | A1 | 3/2015 | Dixon et al. | |
| 2015/0096815 | A1 | 4/2015 | Ottenweller et al. | |
| 2015/0105636 | A1 | 4/2015 | Hayman et al. | |
| 2015/0137988 | A1 | 5/2015 | Gravenstein et al. | |
| 2015/0190293 | A1 | 7/2015 | Hacikadiroglu et al. | |
| 2015/0216474 | A1 | 8/2015 | Riley et al. | |
| 2016/0014030 | A1 | 1/2016 | Thyni et al. | |
| 2016/0022039 | A1 | 1/2016 | Paul et al. | |
| 2016/0051427 | A1 | 2/2016 | Purwar et al. | |
| 2016/0120717 | A1 | 5/2016 | Wurdeman | |
| 2016/0140307 | A1 | 5/2016 | Brosnan et al. | |
| 2016/0193095 | A1 | 7/2016 | Roussy et al. | |
| 2016/0367420 | A1 | 12/2016 | Zerhusen et al. | |
| 2017/0035628 | A1 | 2/2017 | Naber et al. | |
| 2017/0143565 | A1 | 5/2017 | Childs et al. | |
| 2017/0143566 | A1 | 5/2017 | Elku et al. | |

FOREIGN PATENT DOCUMENTS

| | | | | |
|---|---|---|---|---|
| CA | 2122515 | A1 | 10/1995 | |
| CA | 2122686 | A1 | 11/1995 | |
| CA | 2800154 | A1 | 11/2010 | |
| CN | 1152863 | A | 6/1997 | |
| CN | 2294717 | Y | 10/1998 | |
| CN | 2915071 | Y | 6/2007 | |
| CN | 200960241 | Y | 10/2007 | |
| CN | 204306991 | U | 5/2015 | |
| CN | 104887425 | A | 9/2015 | |
| CN | 204655317 | U | 9/2015 | |
| DE | 2749146 | A1 | 5/1978 | |
| DE | 20303000 | U1 | 7/2003 | |
| EP | 1031337 | A1 | 8/2000 | |
| EP | 1199027 | A2 | 4/2002 | |
| EP | 1859765 | A2 | 11/2007 | |
| EP | 1997466 | A2 | 12/2008 | |
| EP | 2105117 | A2 | 9/2009 | |
| EP | 1623666 | B1 | 12/2009 | |
| EP | 1214035 | B1 | 3/2010 | |
| EP | 2327385 | A2 | 6/2011 | |
| EP | 1226803 | B1 | 8/2011 | |
| EP | 2910226 | A1 | 8/2015 | |
| EP | 2725507 | B1 | 2/2016 | |
| EP | 2327385 | B1 | 3/2016 | |
| GB | 1486991 | A | 9/1977 | |
| JP | 07-008521 | | 1/1995 | |
| JP | 11104190 | A | 4/1999 | |
| JP | 2010154929 | A * | 7/2010 | A61G 5/14 |
| JP | 4896358 | B2 | 3/2012 | |
| JP | 5055523 | B2 | 10/2012 | |
| JP | 5117726 | B2 | 1/2013 | |
| KR | 20130076922 | A | 7/2013 | |
| TW | 201019894 | A | 6/2010 | |
| WO | 9834577 | A1 | 8/1998 | |
| WO | 0185085 | A2 | 11/2001 | |
| WO | 03105095 | A2 | 12/2003 | |
| WO | 2004093023 | A2 | 10/2004 | |
| WO | 2004104619 | A1 | 12/2004 | |
| WO | 2005074369 | A2 | 8/2005 | |
| WO | 2006023447 | A2 | 3/2006 | |
| WO | 2007072501 | A1 | 7/2007 | |
| WO | 2007075701 | A2 | 7/2007 | |
| WO | 2011113070 | A1 | 9/2011 | |
| WO | 2014152550 | A2 | 9/2014 | |
| WO | 2015032003 | A1 | 3/2015 | |
| WO | 2016108582 | A1 | 7/2016 | |

OTHER PUBLICATIONS

Recliners.LA, "Lift Chairs are Improving Life for Young and Old", https://www.recliners.la/blogs/motion-furniture-buying guide/113167876-, Mar. 15, 2016.

Ultra Comfort America, Stellar Comfort UC550-L, 2014.

Astral Health Care, "Opthalmology Day Surgery Chair", URL: http://astralhealthcare.com/?product=opthalmology-day-surgery-chair, downloaded Feb. 13, 2020.

Recliners.LA, Stellar 550 Large Lift Chair Recliner (Ultracomfort), URL: https://www.recliners.la/products/ultra-comfort-stellar-550-large-lift-chair, , downloaded Feb. 13, 2020.

* cited by examiner

MEDICAL SUPPORT APPARATUS WITH STAND ASSISTANCE

CROSS-REFERENCE TO RELATED APPLICATIONS

This application claims priority to U.S. provisional patent application Ser. No. 62/340,694 filed May 24, 2016, by inventors Anish Paul et al. and entitled MEDICAL SUPPORT APPARATUS WITH STAND ASSISTANCE, the complete disclosure of which is hereby incorporated herein by reference.

BACKGROUND

The present disclosure relates to a patient support apparatus, and more particularly to a medical recliner chair.

Medical recliner chairs can be challenging for a patient to safely enter and/or exit, due to limited mobility of the patient and/or one or more medical conditions of the patient. These challenges can remain even when the medical recliner includes a stand-assist function in which the chair is movable between a standing configuration and a seated configuration.

SUMMARY

According to one embodiment, a medical chair is provided that is adapted to move between a standing configuration and a seated configuration in a manner that improves the usability of the chair. In some embodiments, the transition between the standing and seated configurations is accomplished at a speed that is dictated by the patient. In some embodiments, the medical recliner is adapted to ensure that the patient is properly positioned prior to transitioning the patient from a seated position to a standing position, or vice versa. In still other embodiments, one or more of the other features discussed in more detail below are provided.

According to one embodiment of the disclosure, a chair is provided that includes a seat, an actuator system, a force sensor, and a controller. The actuator system is adapted to tilt and lift the seat such that the seat is movable between a seated configuration and a standing configuration. The force sensor detects a force applied by an occupant of the chair. The controller controls a speed of the actuator system based upon a magnitude of the force detected by the force sensor.

According to another embodiment, a chair is provided that includes a seat, a right armrest, a left armrest, a right armrest sensor, a left armrest sensor, an actuator system, and a controller. The actuator system is adapted to tilt and lift the seat such that the seat is movable between a seated configuration and a standing configuration. The right armrest sensor detects a presence of an occupant's right hand on the right armrest. The left armrest sensor detects a presence of the occupant's left hand on the left armrest. The controller prevents movement of the seat from the seated configuration to the standing configuration, and/or vice versa, when the right and left armrest sensors do not detect the presence of the occupant's right and left hands on the right and left armrests, respectively.

According to still other embodiments, the force sensor is positioned at the seat such that at least a portion of the occupant's weight is detected by the force sensor when the seat is in the seated configuration and the chair is occupied by the occupant. The controller adjusts the speed of the actuator system during movement between the seated configuration and standing configuration based upon changes in the magnitude of the force detected by the force sensor.

A second force sensor is included in some embodiments that detects a second force applied by the occupant of the chair. In such embodiments, the controller controls the speed of the actuator system based also upon a magnitude of the second force detected by the second force sensor. The second force sensor may be positioned at an end of one of the armrests. The controller may increase the speed of the actuator system in response to the magnitude of the second force increasing as the seat moves from the seated configuration to the standing configuration, and decrease the speed of the actuator system in response to the magnitude of the second force decreasing as the seat moves from the seated configuration to the standing configuration. Alternatively, in other embodiments, the controller decreases the speed of the actuator system in response to the magnitude of the second force increasing as the seat moves from the standing configuration to the seated configuration, and increases the speed of the actuator system in response to the magnitude of the second force decreasing as the seat moves from the standing configuration to the seated configuration.

In some embodiments that include both a right armrest force sensor and a left armrest force sensor, the controller controls the speed of the actuator system based upon a combination of a magnitude of the right force and a magnitude of the left force.

One or more safety switches are included in some embodiments. The safety switches are in communication with the controller, and the controller prevents movement of the seat from the seated configuration to the standing configuration, or vice versa, if at least one of the right and left safety switches is not activated, even if forces are detected by any of the force sensors.

In some embodiments, a right and left safety switch are included that are positioned adjacent front ends of the right and left armrests, respectively. The right safety switch and right force sensor may be positioned sufficiently close to each other to be able to be simultaneously activated by the occupant's right hand, and the left safety switch and left force sensors may be positioned sufficiently close to each other to be able to be simultaneously activated by the occupant's left hand.

A pivotable backrest having a backrest force sensor coupled thereto is included in some embodiments. The backrest force sensor detects an amount of force exerted by the occupant against the backrest. The controller controls the speed of the actuator system based also upon a magnitude of the force detected by the backrest force sensor.

In some embodiments, one or more control panels are included on the backrest that include a lockout control. The lockout control selectively enables and disables the occupant's ability to move the seat between the seated configuration and the standing configuration.

An occupant control positioned at a location accessible to the occupant while the occupant is seated on the seat is included in some embodiments. The occupant control allows the occupant to choose whether to move the chair from the standing to seated position, or vice versa. The controller communicates with occupant control and drives the actuator system in response to the force detected by the one or more force sensors only when the occupant has enabled movement of the chair from the standing to seated position, or vice versa. The chair may also include a lockout control positioned at a location accessible to a caregiver associated with the occupant of the chair. The lockout control prevents the occupant control from being enabled by the occupant when the lockout control is activated.

A caregiver control positioned at a location accessible to a caregiver associated with the occupant of the chair is included in some embodiments. The controller drives the actuator system in response to the force detected by the one or more force sensors only when the caregiver control is activated by the occupant.

In some embodiments, the controller controls the speed of the actuator system based upon a speed at which the occupant's weight shifts from a first set of one or more force sensors to a second set of one or more force sensors. The one or more force sensors in the first set are positioned, in some embodiments, to detect forces exerted on the seat of the chair, and the one or more force sensors in the second set are positioned to detect forces exerted on one or more of the armrests of the chair.

Multiple force sensors are included in some embodiments that are used by the controller to determine a center of gravity of the occupant's weight on the seat and use the center of gravity to control the speed of the actuator system.

One or more proximity sensors are also included in some embodiments. The proximity sensors detect a presence or absence of the occupant's legs within a range of a front of the chair. The controller prevents movement of the seat from the seated configuration to the standing configuration, or vice versa, if the proximity sensor(s) do not detect the occupant's legs within the range.

In some embodiments, a caregiver fixed speed control is included and positioned at a location accessible to a caregiver associated with the occupant of the chair. The controller drives the actuator system at a fixed speed in response to activation of the caregiver fixed speed control.

In still other embodiments, a caregiver variable speed control is included and positioned at a location accessible to a caregiver associated with the occupant of the chair. The controller drives the actuator system at a variable speed dictated by the caregiver variable speed control, rather than the magnitude of the force detected by the force sensor, when the caregiver variable speed control is activated.

In still other embodiments, the chair includes a plurality of wheels, a brake for braking the plurality of wheels, and a brake sensor for detecting when the brake is activated or deactivated. The controller prevents movement of the seat from the seated configuration to the standing configuration, or vice versa, when the brake is deactivated.

The armrests are pivotable between use positions and stowed positions, in some embodiments. The controller is adapted to prevent movement of the seat from the seated configuration to the standing configuration, or vice versa, when at least one of the armrests is pivoted to the stowed position.

In some embodiments, a caregiver control is included and positioned at a location accessible to a caregiver associated with the occupant of the chair. The controller drives the actuator system such that the seat is moved from the seated configuration to the standing configuration when the caregiver control is activated and the right and left armrest sensors detect the presence of the occupant's right and left hands on the right and left armrests, respectively. If either the right or left armrest sensor does not detect the presence of the occupant's right or left hands on the right or left armrests, respectively, the controller does not move the seat from the seated configuration to the standing configuration.

Before the various embodiments disclosed herein are explained in detail, it is to be understood that the claims are not to be limited to the details of operation or to the details of construction and the arrangement of the components set forth in the following description or illustrated in the drawings. The embodiments described herein are capable of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the claims to any specific order or number of components. Nor should the use of enumeration be construed as excluding from the scope of the claims any additional steps or components that might be combined with or into the enumerated steps or components.

DETAILED DESCRIPTION OF THE EMBODIMENTS

Figure 1:
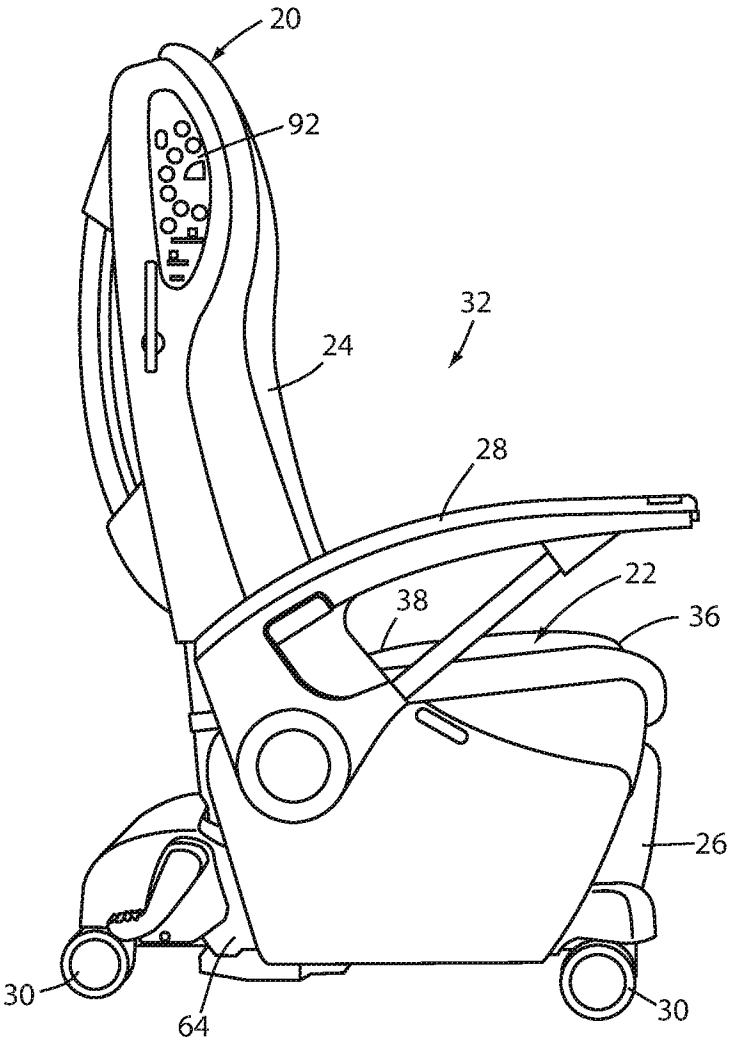
FIG. 1 is a side elevation view of a chair according to a one embodiment of the disclosure shown in a seated configuration.

Referring to FIG. 1, a chair 20 according to one embodiment is shown. Although the following written description will be made with respect to a chair, it will be understood by those skilled in the art that the principles disclosed herein may also be incorporated into other types of patient support apparatuses besides chairs, such as, but not limited to, any beds, stretchers, cots, surgical tables, or the like, that are movable between seated and standing configurations.

Figure 2:
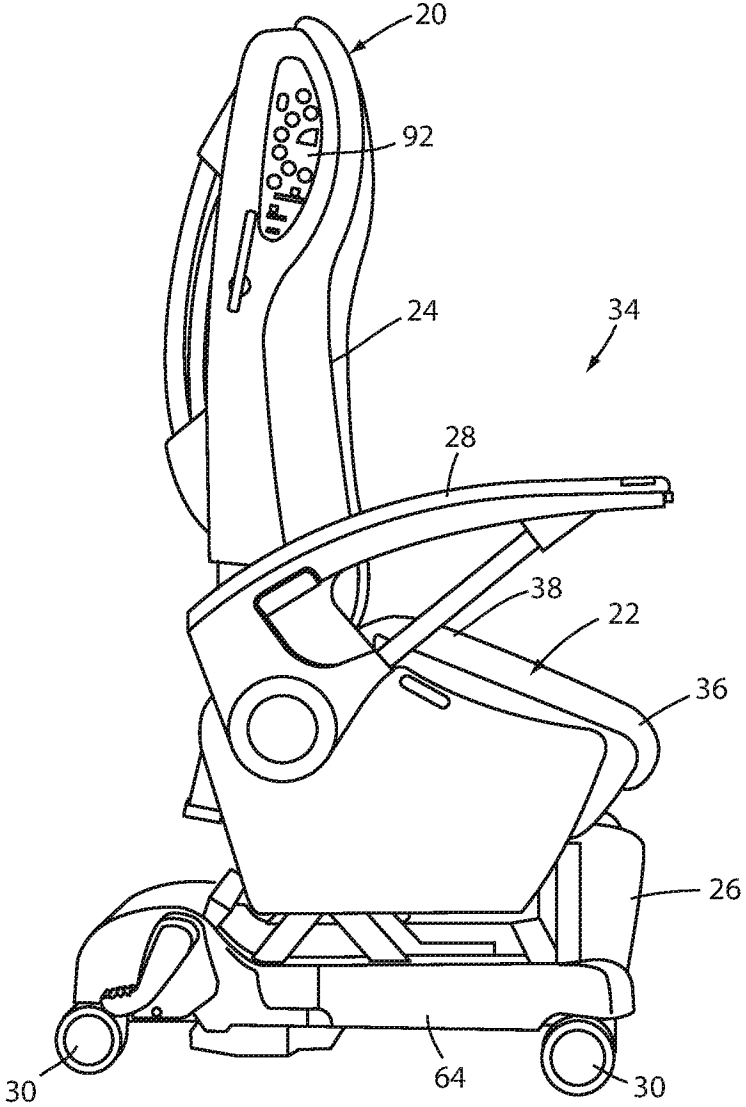
FIG. 2 is a side elevation view of the chair of FIG. 1 shown in a standing configuration.
Figure 3:
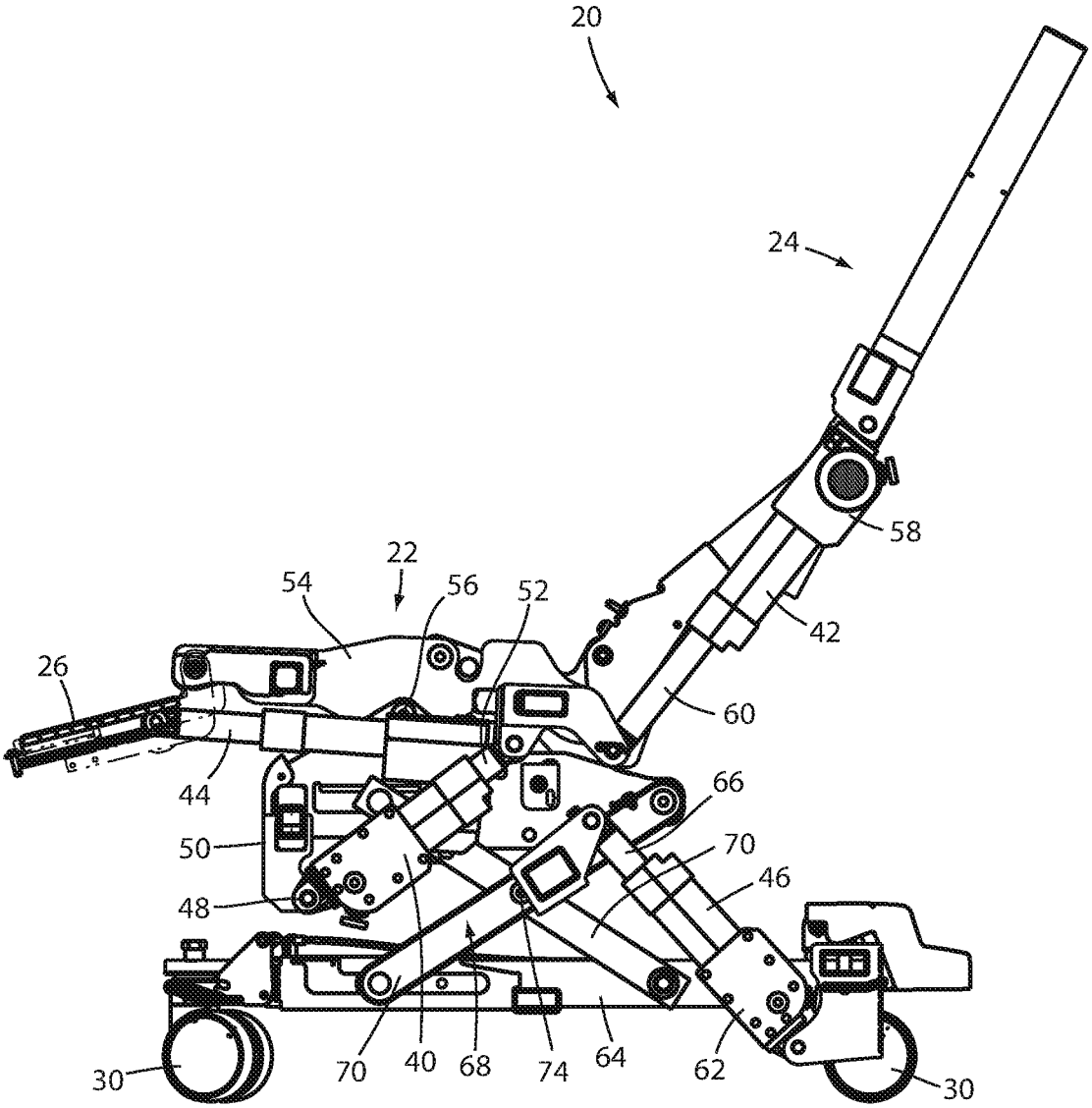
FIG. 3 is a side elevation view of the chair of FIG. 1 shown with a plurality of exterior components removed in order to illustrate several internal components of the chair.

Chair 20 includes a seat 22, a backrest 24, a leg rest 26, a pair of armrests 28, and a plurality of wheels 30. Chair 20 is constructed such that the height and tilt of seat 22 are adjustable. Further, chair 20 is constructed such that backrest 24 is pivotable between a generally upright position, such as shown in FIGS. 1 & 2, and a rearwardly reclined position (not shown). Leg rest 26 is constructed such that it is able to be moved between a retracted position (FIGS. 1 & 2) and an extended position (FIG. 3). Armrests 28 are constructed such that they are pivotable about a substantially horizontal pivot axis between a use position (FIGS. 1 and 2) and a stowed position (not shown).

In addition to the individual movement of the seat 22, backrest 24, and leg rest 26, chair 20 is constructed such that movement of the seat 22 and backrest 24 can be coordinated for moving the chair from a seated configuration 32 (FIG. 1) to a standing configuration 34 (FIG. 2), and vice versa. In the seated configuration 32 (FIG. 1), seat 22 slopes generally backward. That is, a front end 36 of seat 22 is at a higher height than a back end 38 of seat 22. In the standing configuration 34 (FIG. 2), seat 22 generally slopes forward. That is, front end 36 of seat 22 is at a lower height than back end 38 of seat 22. Further, an overall height of seat 22 in the seated configuration 32 is lower than its overall height when the seat 22 is in the standing configuration 34.

Standing configuration 34 is adapted to more easily allow a patient to either exit from chair 20 or to enter chair 20. That is, standing configuration 34 reduces the amount of distance the patient has to move while unsupported by chair 20 when transitioning from either a standing position to a seated position, or vice versa. If a patient is standing and wishes to sit on chair 20, the patient only has to bend his or her knees a small amount before his or her buttocks makes contact with seat 22 while chair 20 is in the standing configuration 34. Conversely, if the patient is seated and wishes to stand, the patient does not have to lift himself or herself as far when chair 20 is in the standing configuration 34 as he or she otherwise would if chair 20 were in the seated configuration 32.

Although FIGS. 1 and 2 illustrate chair 20 having specific orientations for both seat 22 and backrest 24 in the seated and standing configurations 32 and 34, it will be understood that these specific orientations may be varied from those shown in FIGS. 1 and 2. Thus, for example, the specific orientation of either seat 22 and/or backrest 24 while chair 20 is in the seated configuration 32 may be changed from that shown in FIG. 1, and the specific orientation of either seat 22 and/or backrest 24 while chair 20 is in the standing configuration 34 may be changed from that shown in FIG. 2. The seated configuration 32 therefore refers not only to the specific orientations shown in FIG. 1, but also to any orientations of the seat 22 and backrest 24 that comfortably support the patient while he or she is seated. Similarly, the standing configuration 34 therefore refers not only to the specific orientations shown in FIG. 2, but also to any orientations of the seat 22 and backrest 24 that reduce the distance the patient has to travel with his or her buttocks and/or back unsupported by seat 22 and/or backrest 24 when standing up from chair 20 or sitting down onto chair 20.

FIG. 3 illustrates in greater detail one manner in which chair 20 may be internally constructed in order to carry out the movements of chair 20 between the seated and standing configurations 32 and 34, as well as other movement. As shown in FIG. 3, chair 20 includes a seat actuator 40, a backrest actuator 42, a leg rest actuator 44, and a lift actuator 46. Each of actuators 40, 42, 44, and 46 are motorized linear actuators that are designed to linearly extend and retract under the control of a controller 72 (FIGS. 5-10). Seat actuator 40 includes a stationary end 48 that is pivotally mounted to a chassis 50. Seat actuator 40 further includes an extendible end 52 that is pivotally mounted to a seat frame 54. When seat actuator 40 extends or retracts, extendible end 52 causes seat frame 54 to pivot about a seat pivot axis 56. The extension of seat actuator 40 therefore causes seat frame 54 to tilt in such a manner that a forward end of seat 22 moves downward relative to a backward end of seat 22 (i.e. seat frame 54 rotates in a counterclockwise direction as shown in FIG. 3). The retraction of seat actuator 40, in contrast, causes seat frame 54 to tilt in the opposite manner (i.e. seat frame 54 rotates in a clockwise direction as shown in FIG. 3).

Backrest actuator 42 includes a stationary end 58 that is mounted to backrest 24 and an extendible end 60 that is mounted to seat frame 54. The extension and retraction of backrest actuator 42 causes backrest 24 to pivot with respect to seat frame 54. More specifically, when backrest actuator 42 extends, backrest 24 rotates in a counterclockwise direction in FIG. 3. When backrest actuator 42 retracts, backrest 24 rotates in a clockwise direction in FIG. 3. Because backrest 24 is supported on seat frame 54, the rotation of seat frame 54 by seat actuator 40 also causes backrest 24 to rotate as seat frame 54 rotates. This rotation, however, is independent of the rotation of backrest 24 caused by backrest actuator 42. In other words, the relative angle between backrest 24 and seat 22 only changes when backrest actuator 42 is actuated (and not when seat actuator 40 extends or retracts while backrest actuator 42 does not change length). The angle of backrest 24 with respect to a fixed horizontal reference (or another fixed reference), however, changes as seat frame 54 pivots about seat pivot axis 56 (assuming backrest actuator 42 is not activated during this time to counter the rotation of backrest 24 caused by seat actuator 40).

Lift actuator 46 includes a stationary end 62 that is coupled to a base 64 of chair 20 and an extendible end 66 that is coupled to an X-frame 68. X-frame 68 includes two legs 70 that are pivotally coupled to each other about a center axis 74. The legs 70 of X-frame 68 are supported on base 64. The top ends of legs 70 support chassis 50. When lift actuator 46 extends or retracts, the relative angle between each of the legs 70 changes, which changes the overall height of X-frame 68. Further, because chassis 50 is mounted on a top end of X-frame 68, the changing height of X-frame 68 changes the height of chassis 50. Lift actuator 46 therefore raises the height of chassis 50 when it extends and lowers the height of chassis 50 when it retracts. Because seat frame 54 is mounted (pivotally) on chassis 50, and because backrest 24 and leg rest 26 are both mounted to seat frame 54, raising and lowering the height of chassis 50 simultaneously raises and lowers the height of seat 22, backrest 24, and leg rest 26. Further, because armrests 28 are pivotally coupled to backrest 24, raising and lowering the height of chassis 50 also simultaneously raises and lowers the overall height of armrests 28. Extending and retracting lift actuator 46 does not, by itself, change the angular orientations of any of leg rest 26, backrest 24, and/or seat 22, either with respect to each other or with respect to a fixed reference (e.g. the floor).

Leg rest actuator 44 moves leg rest 26 to the used position shown in FIG. 3 when it is extended, and moves leg rest 26 to the stowed position shown in FIGS. 1 and 2 when it is retracted. The construction of leg rest 26 may take on a variety of different forms. In one embodiment, leg rest 26 is constructed in any of the manners shown in commonly assigned U.S. patent application Ser. No. 14/212,417 filed Mar. 14, 2014 by inventors Christopher Hough et al. and entitled MEDICAL SUPPORT APPARATUS, the complete disclosure of which is incorporated herein by reference. The pivoting of leg rest 26 by leg rest actuator 44 does not change the orientation seat 22, backrest 24 or armrests 28. In at least one embodiment of chair 20, unless leg rest 26 is extended to its use position, leg rest actuator 44 is not activated during the movement of chair 20 from its seated configuration 32 to the standing configuration 34. If leg rest 26 is extended to its use position and chair 20 is moved to the standing configuration 34, leg rest actuator 44 is activated during this transition in order to retract leg rest 26.

Figure 4:
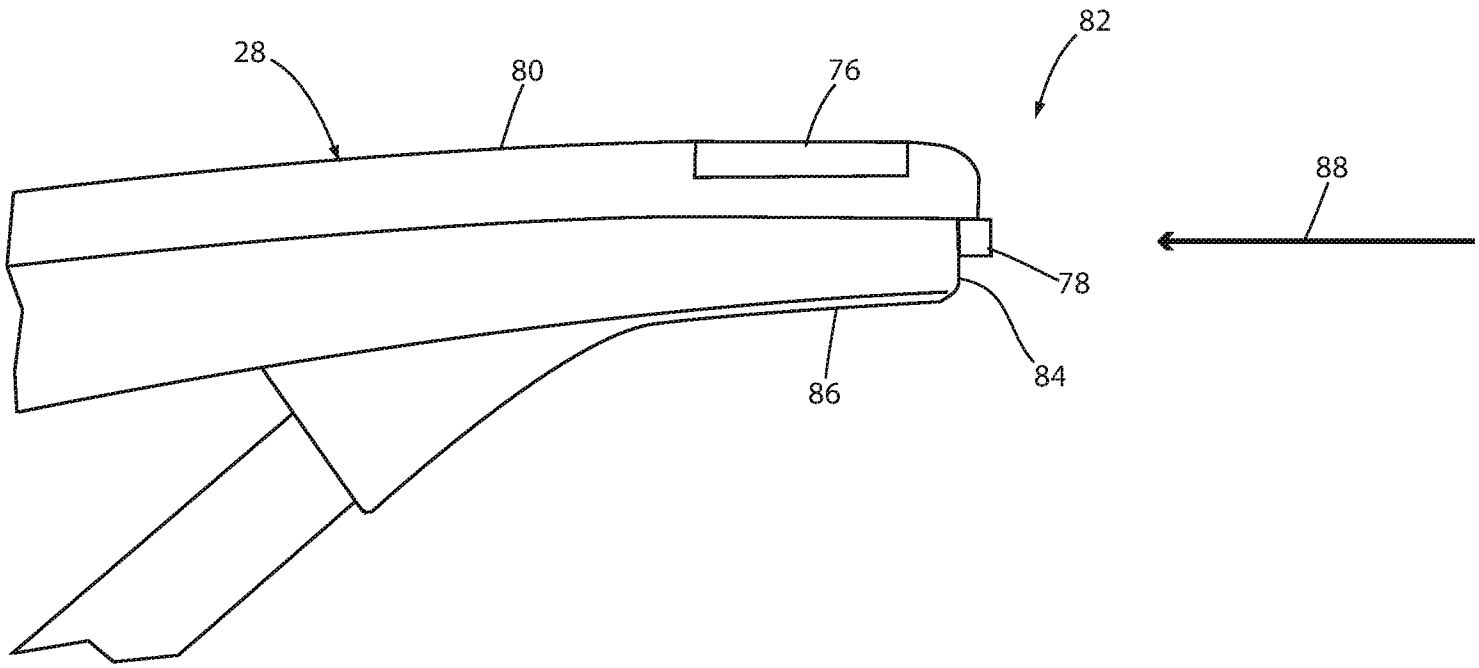
FIG. 4 is a side elevation view of a forward end of one of the armrests of the chair of FIG. 1.

Each armrest 28 includes a force sensor 76 and a safety switch 78 (FIG. 4). Each force sensor 76 is positioned on a top surface 80 of armrest 28 and is adapted to detect downward forces exerted by the occupant of chair 20 when he or she places his or her hand on the corresponding armrest 28 and pushes downwardly. In some embodiments, force sensor 76 is a load cell. In other embodiments, force sensor 76 may be a capacitive sensor, or still another type of force sensor. Regardless of the specific type of sensing technology used by force sensor 76, force sensor 76 may be designed to come into direct contact with the occupant's hands, or it may be concealed under a protective barrier or cover that, when pressed by the occupant, transfers the applied downward force to the force sensor.

Each force sensor 76 is positioned generally adjacent a free end 82 of armrest 28. In the illustrated embodiment, force sensor 76 is dimensioned to only detect downward forces applied by the occupant when he or she presses down on armrest 28 generally in the region of free end 82. That is, downward forces exerted on armrest 28 by the occupant in areas located rearwardly of free end 82 are not detected in the illustrated embodiments. When configured in this manner, force sensors 76 generally only detect occupant forces when the occupant is getting into or out of chair 20 because occupants typically don't apply forces of any significance to the area of free ends 82 when they are not attempting to exit or enter chair 20.

Each safety switch 78 is positioned on a front surface 84 of its corresponding armrest 28 (FIG. 4). Safety switches 78, in the illustrated embodiment, are switches that are adapted to be switched when the occupant pushes on them in a rearward direction indicated by arrow 88 in FIG. 4. In one embodiment, switches 78 are buttons that are pressed by the occupant. In another embodiment, switches 78 are capacitive sensors that detect changes in capacitance caused by the presence or absence of the occupant's hands adjacent free ends 82 of armrests 28. When implemented as capacitive sensors, switches 78 can be implemented without incorporating any moving parts. Other sensing technologies and/or physical constructions of safety switches 78 may also be implemented, such as, but not limited to, acoustic type touch sensors.

The location of safety switches 78 may also be changed from that shown in FIG. 4. For example, in one embodiment, safety switches 78 are positioned on a bottom surface 86 of armrests 28, rather than front surface 84. Safety switches 78 could also alternatively be moved from front surface 84 to top surface 80. In those embodiments of chair 20 (discussed more below) where chair 20 does not include force sensors 76, safety switches 78 may be placed in the location where force sensors 76 are shown to be in FIG. 4. Alternatively in some embodiments, safety switches 78 may be eliminated and the function provided by safety switches 78 can be performed by force sensors 76, as will also be discussed in greater detail below. When both safety switches 78 and force sensor 76 are included on chair 20, however, they are desirably positioned, in at least some of such embodiments, such that they can both be simultaneously activated by the occupant's hands. That is, each safety switch 78 is positioned close enough to its neighboring force sensor 76 such that when the occupant exerts a downward force against force sensor 76, he or she can simultaneously press, or otherwise activate, safety switch 78 via his or her hand or fingers. The reasons for this simultaneous activation are discussed in greater detail below.

The operation and movement of actuators 40-46, whether moved individually or in a coordinated fashion, is carried out via a control system 90. FIGS. 5-10 illustrate six different embodiments of control systems 90 that may be used with chair 20. In addition, as will be discussed further below, additional modifications can be made to any of the control systems 90 discussed herein, including the removal and/or addition of one or more components and/or features.

Figure 5:
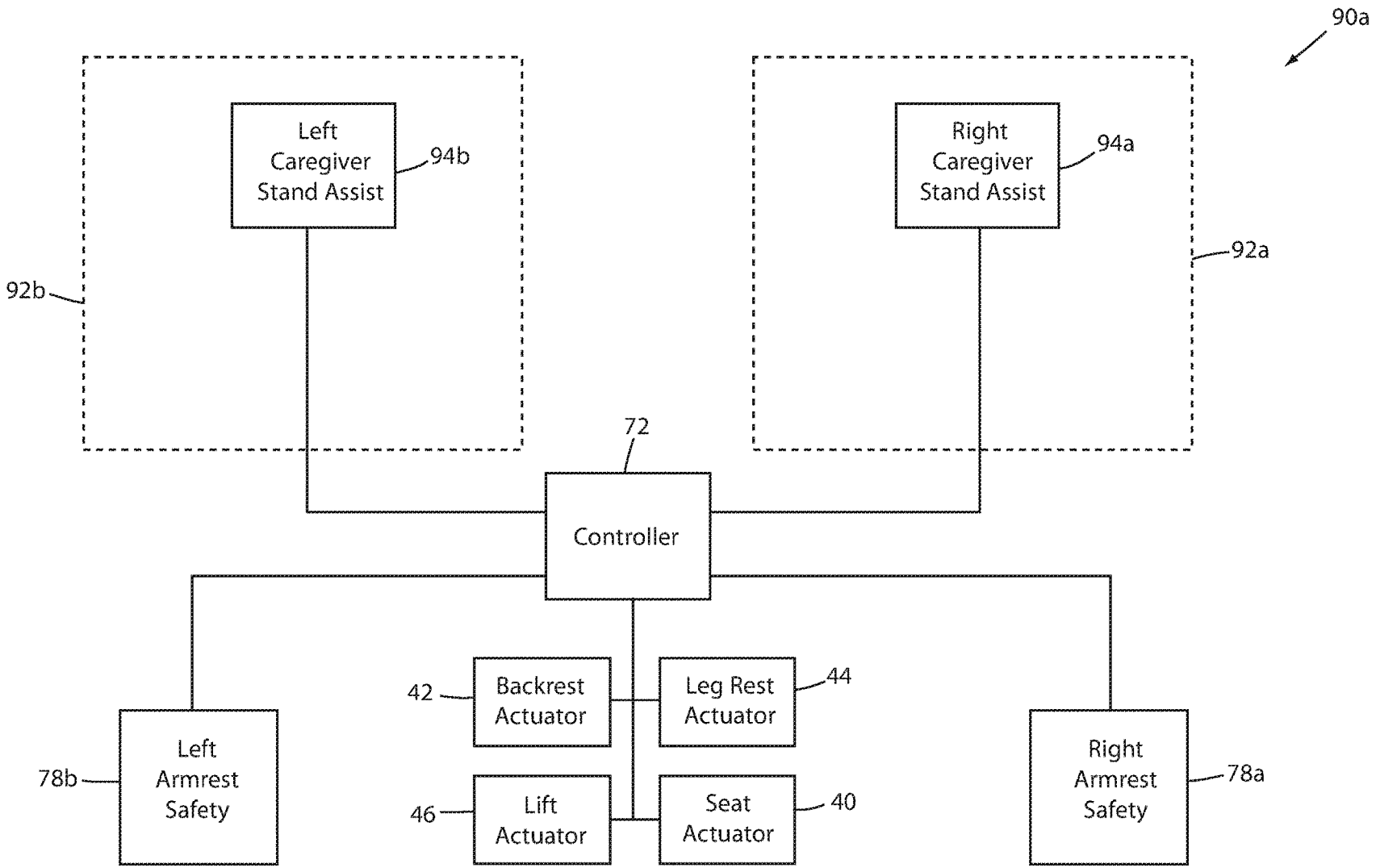
FIG. 5 is a block diagram of a first embodiment of a control system that is usable with the chair of FIG. 1.

A control system 90*a* according to a first embodiment is shown in FIG. 5. Control system 90*a* includes a controller 72 that is in communication with seat actuator 40, backrest actuator 42, leg rest actuator 44 and lift actuator 46. Controller 72 is further in communication with a right control panel 92*a*, a left control panel 92*b*, a right safety switch 78*a*, a left safety switch 78*b*, and one or more memories (not shown). Right and left safety switches 78*a* and 78*b* are coupled to the right and left armrests 28, respectively, and may be positioned at any of the locations discussed above and/or as shown in FIG. 4. Right and left controls panels 92*a* and 92*b* are positioned at locations that are easily accessible to one or more caregivers associated with an occupant of chair 20. In the embodiment shown in FIGS. 1 and 2, each control panel 92*a* and 92*b* is positioned along a side of backrest 24 generally near a top of backrest 24. When located here, the control panels 92*a* and 92*b* are high enough such that a typical caregiver does not have to bend down to reach them, and are also positioned at a location that is difficult for an occupant of chair 20 to reach, thereby helping to prevent the occupant from accessing the control features that can be carried out by control panels 92*a* and 92*b*.

Controller 72 is constructed of any electrical component, or group of electrical components, that are capable of carrying out the functions described herein. In many embodiments, controller 72 is microprocessor based, although not all such embodiments need include a microprocessor. In general, controller 72 includes any one or more microprocessors, microcontrollers, field programmable gate arrays, systems on a chip, volatile or nonvolatile memory, discrete circuitry, and/or other hardware, software, or firmware that is capable of carrying out the functions described herein, as would be known to one of ordinary skill in the art. Such components can be physically configured in any suitable manner, such as by mounting them to one or more circuit boards, or arranging them in other manners, whether combined into a single unit or distributed across multiple units. The instructions followed by controller 72 in carrying out the functions described herein, as well as the data necessary for carrying out these functions, are stored in one or more memories that are accessible to controller 72.

In one embodiment, controller 72 communicates with individual circuit boards contained within each control panel 92*a* and 92*b* using an I-squared-C communications protocol. It will be understood that, in alternative embodiments, controller 72 could use alternative communications protocols for communicating with control panels 92*a* and 92*b* and/or with the other components of control system 90*a*. Such alternative communications protocols includes, but are not limited to, a Controller Area Network (CAN), a Local Interconnect Network (LIN), Firewire, and one or more Ethernet switches, such as disclosed in commonly assigned, copending U.S. patent application Ser. No. 14/622,221 filed Feb. 13, 2015 by inventors Krishna Bhimavarapu et al. and entitled COMMUNICATION METHODS FOR PATIENT HANDLING DEVICES, the complete disclosure of which is incorporated herein by reference. Still other forms of communication are possible.

Each control panel 92*a* and 92*b* includes a caregiver stand assist control 94*a* and 94*b*, respectively. Caregiver stand assist controls 94*a* and 94*b* may include one or more buttons, switches, or dials on each control panel 92*a* and 92*b*. Alternatively, if control panels 92*a* and 92*b* are implemented as touch screens, controls 94*a* and 94*b* may correspond to one or more areas on each of control panels 92*a* and 92*b*. When implemented as a touch screen, control panels 92*a* and 92*b* may be constructed in accordance with the touch screens disclosed in commonly assigned U.S. patent application Ser. No. 14/282,383 filed May 20, 2014 by applicants Christopher Hopper et al. and entitled THERMAL CONTROL SYSTEM, the complete disclosure of which is incorporated herein by reference. Alternatively, control panels 92*a* and 92*b* may be constructed in accordance with any of the touch screens disclosed in commonly assigned U.S. patent application Ser. No. 62/166,354 filed May 26, 2015, by inventors Michael Hayes et al. and entitled USER INTERFACES FOR PATIENT CARE DEVICES, the complete disclosure of which is also hereby incorporated herein by reference.

In still other embodiments, control panels 92*a* and 92*b* may be implemented as virtual control panels in which controls 94*a* and 94*b* correspond to one or more areas of a surface on which control images are projected. Some examples of such virtual control panels are disclosed in commonly assigned U.S. patent application Ser. No. 14/549,006 filed Nov. 20, 2014 by inventors Richard Derenne et al. and entitled PERSON SUPPORT APPARATUSES WITH VIRTUAL CONTROL PANELS, the complete disclosure of which is hereby incorporated herein by reference. Other types of virtual control panels and/or touch panels may also be implemented.

Regardless of the physical implementation of controls 94*a* and 94*b* and control panels 92*a* and 92*b*, controls 94*a* and 94*b* are used by the caregiver when he or she wants to have controller 72 move chair 20 either from the seated configuration 32 to the standing configuration 34, or vice versa. In some instances, there may be a separate control 94*a* for moving from the seated configuration 32 to the standing configuration 34 and for moving from the standing configuration 34 to the seated configuration 32. In other embodiments, a single control 94 is provided that automatically moves chair 20 from whichever of the seated and standing configurations 32 and 34 it is currently closest to to the other of the seated and standing configurations 32 and 34.

Although not shown in FIG. 5, control panels 92*a* and 92*b* may also include controls for carrying out any one or more additional functions of chair 20. Such functions may include, but are not limited to, arming and disarming an exit detect detection system, moving any one or more of the actuators 40-46 (either individually or collectively) in manners that don't involve movement between seated configuration 32 and standing configuration 34 (e.g. reclining backrest 24 and/or extending leg rest 26), and/or activating and deactivating a brake for wheels 30. In some embodiments, the additional controls included on control panels 92*a* and 92*b* include any one or more of the controls disclosed in commonly assigned U.S. patent application Ser. No. 62/171,472, filed Jun. 5, 2015, by inventors Aaron Furman et al. and entitled PATIENT SUPPORT APPARATUSES WITH DYNAMIC CONTROL PANELS, the complete disclosure of which is incorporated herein by reference. Other controls and/or functions may also be added to control panels 92*a* and 92*b*. If an exit detection system is included, the exit detection may be constructed in the manner disclosed in commonly assigned U.S. patent application 62/268,549, filed Dec. 17, 2015, by inventors Anish Paul et al. and entitled PERSON SUPPORT APPARATUS WITH EXIT DETECTION SYSTEM, the complete disclosure of which is hereby incorporated herein by reference. Other types of exit detection systems may, of course, be used.

Control system 90*a* is adapted to control the transitioning of chair 20 between seated configuration 32 and standing configuration 34 in response to two inputs: (1) a caregiver activating at least one of the stand assist controls 94*a* and 94*b*; and (2) the occupant activating one or both of safety switches 78*a* and 78*b*. If both of these two inputs are not present, controller 72 does not transition chair 20 between the seated and standing configurations 32 and 34. In one embodiment, if both inputs are initially present and the caregiver later releases the stand assist control 94*a* and/or 94*b* (e.g. by no longer pressing on it), movement of chair 20 to the standing or seated configuration 32 or 34—as the case may be—continues so long as one or both of safety switches 78*a* and 78*b* remained activated by the occupant.

Control system 90*a* therefore enables chair 20 to move between the seated and standing configurations 32 and 34, but only when the occupant has his or her hands properly positioned on armrests 28 in locations that will provide support while standing up or sitting down. Further, in those embodiments where the caregiver can release control 94*a* and 94*b* but have the motion of chair 20 continue, the caregiver, after releasing control 94*a* or 94*b*, has both hands free to help support the occupant while he or she sits down or stands up. This allows the caregiver to provide better assistance than what might otherwise be possible if the caregiver were required to keep one hand or finger on control 94*a* or 94*b*.

In those embodiments where the caregiver is free to release control 94*a* and/or 94*b* and have the motion of chair 20 continue toward either seated or standing configuration 32 or 34, controller 72 not only stops movement of chair 20 in response to one or both of safety switches 78*a* and 78*b* becoming deactivated by the occupant, but also in response to the caregiver re-pressing (or otherwise re-activating) one of controls 94*a* and 94*b*. Thus, for example, if the caregiver initially presses control 94*a* while the occupant has activated switches 78*a* and 78*b*, then moves his or her hand off of control 94*a* to help the occupant, but then subsequently wants to stop movement of chair 20 prior to reaching the seated or standing configurations 32 or 34, the caregiver can do so by re-pressing control 94*a* (or 94*b*). In this manner, the caregiver always retains the ability to stop the motion of chair 20 and does not need to rely upon the occupant to do so.

Control system 90*a* controls the movement of chair 20 between the seated and standing configurations 32 and 34 such that chair 20 travels at a substantially constant speed, in one embodiment. In another embodiment, control system 90*a* controls the movement of chair 20 between the seated and standing configurations 32 and 34 such that chair 20 travels at a variable speed, but the variable speed is independent of the occupant's position and/or weight distribution on chair 20. Other control systems, such as will be discussed below, however, can be used with chair 20 that change the speed of chair 20 based upon the occupant's position and/or weight distribution.

Control system 90*a* provides the occupant of chair 20 with the opportunity to dictate when the motion of chair 20 starts or stops, while still being able to use both of his or her hands for supporting himself or herself by grabbing onto the ends of armrests 28. This opportunity is provided, for example, by having the caregiver instruct the occupant not to press on either of safety switches 78*a* or 78*b* until after the caregiver has activated one of controls 94*a* or 94*b*. Thereafter, as long as the caregiver continues to activate control 94*a* or 94*b*, movement of the chair 20 will not commence until the occupant presses on one or both of safety switches 78*a* and 78*b*. This lets the occupant control the commencement of chair 20'*s* movement, thereby letting the occupant get into position before any movement starts and avoiding any sudden unexpected movement of chair 20 from the point of view of the occupant. Further, the occupant can control precisely when chair 20 stops moving by releasing one or both of safety switches 78*a* or 78*b*. In this manner, if initial movement begins and the occupant realizes in response to that initial movement that he or she is not quite in the right position for making the transition, he or she can stop the movement and shift his or her body into a more prepared position. Alternatively, if the occupant wants to stop movement at any arbitrary time during the transitioning movement, he or she is able to do so by releasing one or both of safety switches 78*a* and 78*b*.

Figure 6:
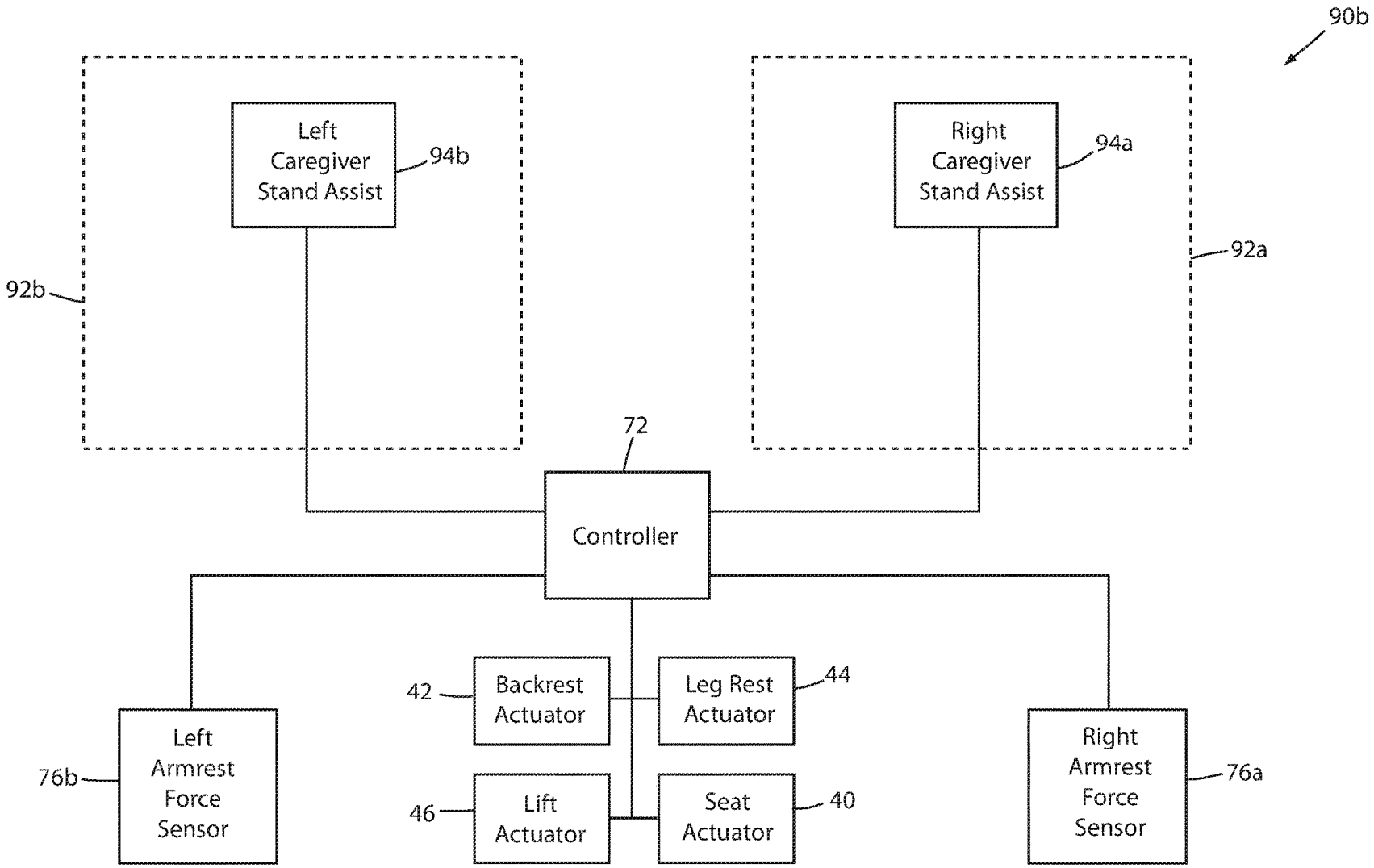
FIG. 6 is a block diagram of a second embodiment of a control system that is usable with the chair of FIG. 1.

FIG. 6 illustrates an alternative embodiment of a control system 90*b* that may be incorporated into chair 20 in lieu of control system 90*a*. Those elements of control system 90*b* that are the same as elements found in control system 90*a* are provided with the same reference number and, unless otherwise noted below, operate in the same manner as discussed above, and may be modified in any of the manners discussed above.

Control system 90*b* is adapted to control the transitioning of chair 20 between seated configuration 32 and standing configuration 34 in response to two inputs: (1) a caregiver activating at least one of the stand assist controls 94*a* and 94*b*; and (2) the occupant exerting a force on one or both of force sensors 76*a* and 76*b*. Control system 90*b* therefore differs from control system 90*a* in that force sensors 76*a* and 76*b* have replaced safety switches 78*a* and 78*b*. Force sensors 76*a* and 76*b*, however, still fulfill the same function as safety switches 78*a* and 78*b*. That is, one or both of force sensors 76*a* and 76*b* must continue to detect a force in order for controller 72 to continue with the movement between seated configuration 32 and standing configuration 34.

Control system 90*b* also differs from control system 90*a* in the manner in which controller 72 carries out the activation of actuators 40-46. Specifically, controller 72 of control system 90*b* is programmed to dynamically adjust the speed commands given to at least one of actuators 40-46 based upon the amount of force detected by one or both of force sensors 76*a* and 76*b*, and to vary those speed commands in response to changes in the forces detected by sensors 76*a* and 76*b*.

In one embodiment of chair 20 having control system 90*b* incorporated therein, when chair 20 is moving from the seated configuration 32 to the standing configuration 34, controller 72 of control system 90*b* speeds up this transitioning in response to greater amounts of force being applied to force sensors 76*a* and/or 76*b*. These greater amounts of force are indications that the occupant has shifted his or her weight more forwardly, and is therefore closer to attaining the standing position. In order to bring the chair closer to its standing configuration, and thus match the occupant's greater readiness for standing, controller 72 speeds up the movement of chair 20 toward standing configuration 34. Conversely, if sensors 76*a* and/or 76*b* sense lesser amounts of force, it is indicative that the occupant is still supporting himself or herself primarily on seat 22, rather than on armrests 28 or his or her legs. In this situation, controller 72 slows down movement of chair 20 toward standing configuration 34 so that the occupant has more time to shift his or her weight in preparation for standing.

In this same embodiment, controller 72 does the opposite when moving chair 20 from the standing configuration 34 to the seated configuration 32. That is, controller 72 of control system 90*b* slows down the transitioning movement of chair 20 in response to greater amounts of force being applied by the occupant to force sensors 76*a* and 76*b* when moving chair 20 to the seated configuration. These greater amounts of force are indications that the occupant has not shifted his or her weight rearwardly onto seat 22, but instead is still primarily standing and/or obtaining substantial support from armrests 28 rather than seat 22. In those situations, controller 72 slows down the movement of chair 20 toward seated configuration 32. Conversely, if force sensors 76*a* and/or 76*b* detect relatively less force, this provides an indication that the occupant is not relying on the armrests 28 for primary support, but may instead be leaning or sitting against seat 22, and therefore ready to be moved to the seated configuration 32. Controller 72 therefore speeds up the movement toward seated configuration 32.

Controller 72 of control system 90*b* is adapted to not only determine an initial speed of chair 20 based upon the outputs of force sensors 76*a* and 76*b*, but also to repetitively adjust the speed of chair 20 based upon changes in those outputs during the transition between seated and standing configurations 32 and 34. That is, controller 72 repetitively receives signals from force sensors 76*a* and 76*b* during the movement of chair 20 and makes adjustments, as appropriate, to the speed of chair 20 as it transitions between seated and standing configurations 32 and 34. As noted above, the types of speed adjustments may vary depending upon whether controller 72 is moving chair 20 to the seated configuration 32 or to the standing configuration 34.

In some embodiments, controller 72 controls the transition speed of chair 20 based upon a sum of the force outputs of force sensors 76*a* and 76*b*. In other embodiments, controller 72 averages the outputs of force sensors 76*a* and 76*b* and uses the average for controlling the transition speed of chair 20. In still other embodiments, controller 72 combines the outputs from force sensors 76*a* and 76*b* in different manners, or utilizes programmed logic to select and use the output from only one of the two force sensors 76*a* and 76*b*.

Regardless of how the force outputs from sensors 76*a* and 76*b* are combined or selected for use by controller 72, controller 72 is programmed in at least one embodiment to control the speed of chair 20 in an open loop manner based on the selected force output(s). In another embodiment, controller 72 is programmed to control the speed of chair 20 in a closed loop manner wherein one or more sensors (not shown) provide speed feedback indicative of the actual speed of chair 20, and controller 72 uses the speed feedback to make adjustments, as appropriate, to reach a target speed.

In some embodiments, controller 72 also takes into account the current position of chair 20 when making adjustments to the speed at which chair 20 is transitioning. In one such embodiment, controller 72 moves chair 20 within a smaller speed range during the initial stages of movement and expands this range as chair 20 gets closer to reaching the end state of its movement (either seated configuration 32 or standing configuration 34). In this manner, the occupant is not subjected to large speed variations during the initial moments when starting to sit or stand, thereby giving the occupant more time to adjust his or her weight as the transitioning movement begins. As the transitioning movement approaches its end state, however, it is more likely that the occupant has by that time shifted his or her weight in a manner that matches the desired end state, and therefore may be more likely to safely respond to greater speeds.

Control system 90*b* may also be used with an alternative embodiment of chair 20 from the one shown illustrated in FIG. 4. Specifically, control system 90*b* may be used with a chair 20 that has force sensors 76*a* and 76*b* positioned at different locations from what is shown in FIG. 4. As shown in FIG. 4, force sensors 76*a* and 76*b* are placed at locations that detect the amount of force the occupant is exerting against armrests 28 in order to support himself or herself with armrests 28. In an alternative embodiment of chair 20, force sensors 76*a* and 76*b* are moved to a side of armrests 28 (or to front surface 84) where force sensors 76*a* and 76*b* no longer detect how hard the occupant is pushing down on armrests 28, but instead detect how much force the occupant is exerting against the force sensors 76*a* and 76*b* with his or her fingers or thumb. By placing the force sensors 76*a* and 76*b* in this location, the occupant can change the speed of chair 20 based upon how hard he or she squeezes his or her fingers or thumb against force sensors 76*a* and 76*b*, rather than how hard he or she is pushing down on armrests 28. This enables the occupant to control the speed of chair 20 independently of how much or how little he or she is relying on armrests 28 for support.

In this modified embodiment of chair 20, control system 90*b* controls the speed of chair 20 based upon how hard the occupant is pressing his or her fingers or thumb against force sensors 76*a* and 76*b*. Further, in this modified embodiment, controller 72 changes the speed of chair 20 in the same manner regardless of which direction chair 20 is moving in. In other words, regardless of whether chair 20 is moving from seated configuration 32 to standing configuration 34, or vice versa, controller 72 speeds up the movement of chair 20 when the occupant presses his or her fingers or thumb harder against force sensors 76*a* and 76*b*, and slows down the movement of chair 20 when the occupant presses his or her fingers or thumb more lightly against force sensors 76*a* and 76*b*. If no force is detected, controller 72 stops movement of chair 20. Controller 72 may control the speed of chair 20 in this embodiment using open or closed loop control, and/or it may or may not take into account the current position of the chair when varying its speed.

Figure 7:
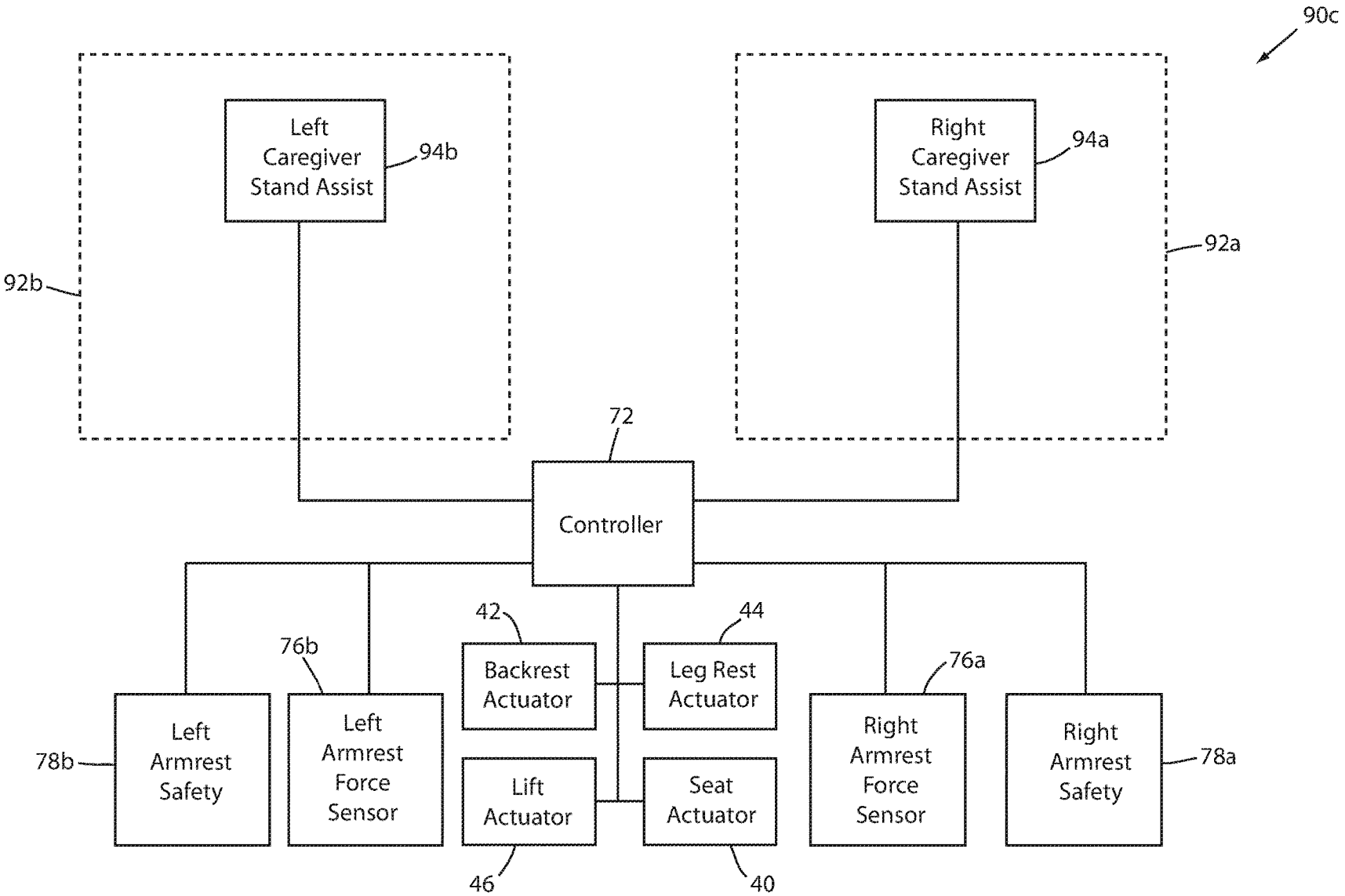
FIG. 7 is a block diagram of a third embodiment of a control system that is usable with the chair of FIG. 1.

FIG. 7 illustrates an alternative embodiment of a control system 90*c* that may be incorporated into chair 20 in lieu of control systems 90*a* or 90*b*. Those elements of control system 90*c* that are the same as elements found in control systems 90*a* or 90*b* are provided with the same reference number and, unless otherwise noted below, operate in the same manner as discussed above, and may be modified in any of the manners discussed above.

Control system 90*c* is adapted to control the transitioning of chair 20 between seated configuration 32 and standing configuration 34 in response to three inputs: (1) a caregiver activating at least one of the stand assist controls 94*a* and 94*b*; (2) the occupant activating one or both of safety switches 78*a* or 78*b*; and (3) the occupant exerting a force on one or both of force sensors 76*a* and 76*b*. Control system 90*c* therefore differs from control systems 90*a* and 90*b* in that it combines force sensors 76 and 76*b* with safety switches 78*a* and 78*b*, as well as caregiver controls 94*a* and 94*b*. Force sensor 76*a* and 76*b*, safety switches 78*a* and 78*b*, and controls 94*a* and 94*b* all operate in the same manner as previously described, however, controller 72 does not initiate movement until all three of these components (control 94, safety switch 78, and force sensor 76) are activated.

Once movement is initiated, in one embodiment, it is only maintained for as long as the occupant continues to activate one of safety switches 78*a* or 78*b*. That is, once movement of chair 20 is initiated, the caregiver is free to remove his or her hand from control panel 92*a* or 92*b* without causing movement of chair 20 to stop. The occupant, however, can stop the movement by releasing one of switches 78*a* or 78*b*. Further, unlike at least one embodiment of control system 90*b*, the occupant can stop the movement of chair 20 even while exerting forces against one or both of force sensors 76*a* and 76*b*. That is, unlike the embodiment of control system 90*b* where the occupant cannot stop movement once it begins other than by applying zero, or close to zero, force against force sensors 76*a* and/or 76*b*, control system 90*c* enables the occupant to stop chair 20 while still exerting a supportive force against one or both of the armrests 28 (as detected by force sensors 76*a* or 76*b*). In this embodiment, force sensors 76*a* and 76*b* are positioned in the location shown in FIG. 4, rather than on the sides of armrests 28 or at other locations where they can be controlled independently of the amount of supportive force exerted by the occupant on armrests 28.

Control system 90*c* controls the speed of chair 20 in any of the same manners discussed above with respect to control system 90*b* based upon the amount of force detected by force sensors 76*a* and 76*b*. However, as noted, such variable speed control only occurs while the occupant is simultaneously activating at least one of safety switches 78*a* or 78*b*. When the occupant releases, or otherwise deactivates, either or both of safety switches 78*a* or 78*b*, controller 72 stops the movement of chair 20.

As was noted above, in one embodiment of chair 20 having control system 90*c* installed therein, the caregiver is free to release controls 94*a* and/or 94*b* after movement commences. Upon releasing of controls 94*a* and/or 94*b*, movement of chair 20 will continue until the occupant either stops the chair 20 or the chair reaches its desired end state (seated or standing configuration 32 or 34). In this embodiment, if the caregiver wishes to stop the chair before it reaches the desired end state, the caregiver can do so by pressing on one of controls 94*a* or 94*b* again, or otherwise re-activating them. In this manner, both the caregiver and occupant have the ability to stop movement of chair 20 during the transition between seated and standing configurations 32 and 34.

In an alternative embodiment, control system 90*c* is configured such that the caregiver must keep his or her hand on one of controls 94*a* or 94*b* throughout the entire transition between sitting and standing configurations 32 and 34. In this embodiment, the movement of chair 20 stops if the caregiver releases control 94*a* or 94*b* before chair 20 reaches its desired end state.

Figure 8:
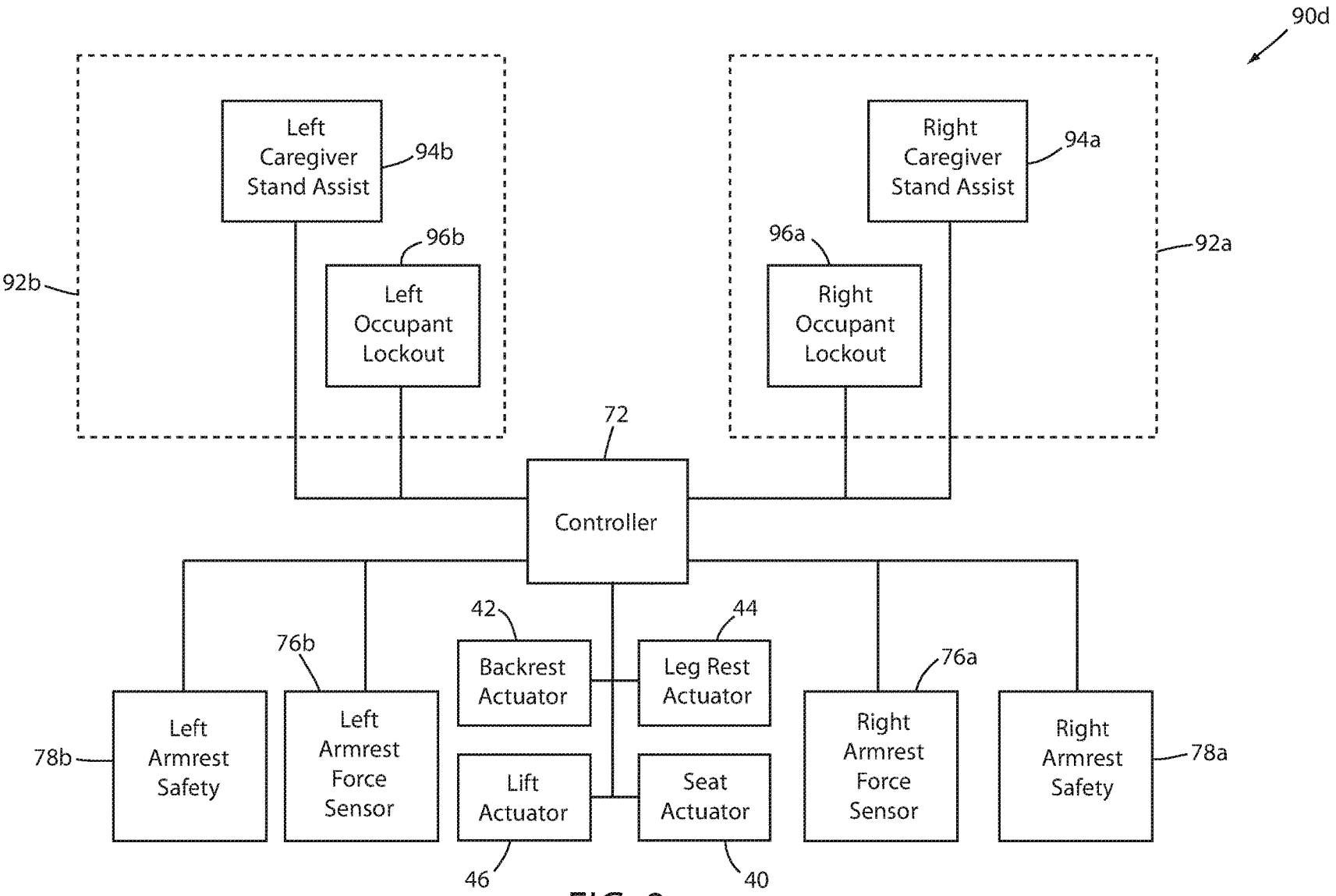
FIG. 8 is a block diagram of a fourth embodiment of a control system that is usable with the chair of FIG. 1.

FIG. 8 illustrates an alternative embodiment of a control system 90*d* that may be incorporated into chair 20 in lieu of control systems 90*a*, 90*b*, or 90*c*. Those elements of control system 90*d* that are the same as elements found in control systems 90*a*, 90*b*, and/or 90*c* are provided with the same reference number and, unless otherwise noted below, operate in the same manner as discussed above, and may be modified in any of the manners discussed above.

Control system 90*d* includes all of the same elements as control system 90*c* with the addition of a pair of lockout controls 96*a* and 96*b* located on control panels 92*a* and 92*b*, respectively. Control system 90*d* controls chair 20 in the same manner as control system 90*c* with the exception that, unlike control system 90*c*, control system 90*d* allows the occupant of chair 20 to initiate and complete movement of chair 20 from seated configuration 32 to standing configuration 34, or vice versa, without the presence of a caregiver. That is, it is not necessary for a caregiver to press on, or other activate, one of stand assist controls 94*a* or 94*b* in order to chair 20 to begin moving between its seated and standing configurations.

Lockout controls 96*a* and 96*b*, however, give the caregiver the option of whether or not to allow the occupant to be able to transition between these two configurations without having a caregiver present. That is, if the caregiver does not activate a lockout feature of chair 20 by activating one of lockout controls 96*a* or 96*b*, then the occupant is free to move chair 20 between these configurations by simultaneously pressing on at least one safety switch 78 while exerting a force on at least one force sensor 76. Further, the occupant is able to control the speed of chair 20 based upon the amount of force exerted on the force sensors 76*a* and 76*b*. Force sensors 76*a* and 76*b* may be located in the position shown in FIG. 4, or they may be located on the sides of the armrests 28, or elsewhere (such as, but not limited to, on, in or under seat 22).

If, however, the caregiver does not want the occupant of chair 20 to be able to move chair 20 without the caregiver present, the caregiver activates the lockout feature of chair 20 by pressing on, or otherwise activating, one of lockout controls 96*a* or 96*b*. When the lockout feature is activated, controller 72 will not move chair 20 between the seated and standing configurations 32 and 34, even if the occupant simultaneously activates one or both of safety switches 78*a* and 78*b* while applying a force to one or both of force sensors 76*a* and 76*b*.

Control system 90*d* also includes stand assist controls 94*a* and 94*b*. These are used when the caregiver wishes to move chair 20 between the seated and standing configurations 32 and 34. In one embodiment of control system 90*d*, stand assist controls 94*a* and 94*b* initiate and control movement of chair 20 without regard to any inputs, or lack of inputs, applied by the occupant to either of force sensors 76 or safety switches 78. That is, the caregiver has complete control over the movement of chair 20 between the two configurations 32 and 34.

In another embodiment of control system 90*d*, stand assist controls 94*a* and 94*b* function as caregiver proxies for safety switches 78*a* and 78*b* and relieve the occupant of the task of having to activate safety switches 78*a* or 78*b*. In this embodiment, when the caregiver activates one of controls 94*a* or 94*b*, chair 20 moves between the configurations 32 and 34 in response to forces applied to force sensors 76*a* or 76*b* and stops moving when either the occupant stops applying forces or the caregiver stops activating one of controls 94*a* or 94*b* (or the chair 20 reaches it desired end state). The speed of movement is responsive to the amount of force applied by the occupant.

In still another embodiment of control system 90*d*, controller 72 only moves chair 20 between the two configurations 32 and 34 when all three of the following simultaneously occur: (1) one or both of controls 94*a* and 94*b* are activated; (2) one or both of safety switches 78*a* and 78*b* are activated, and (3) forces above a threshold are detected by one or both of force sensors 76*a* and 76*b*. Controller 72 stops movement of chair 20 in this embodiment when any one of these three conditions is terminated.

Figure 9:
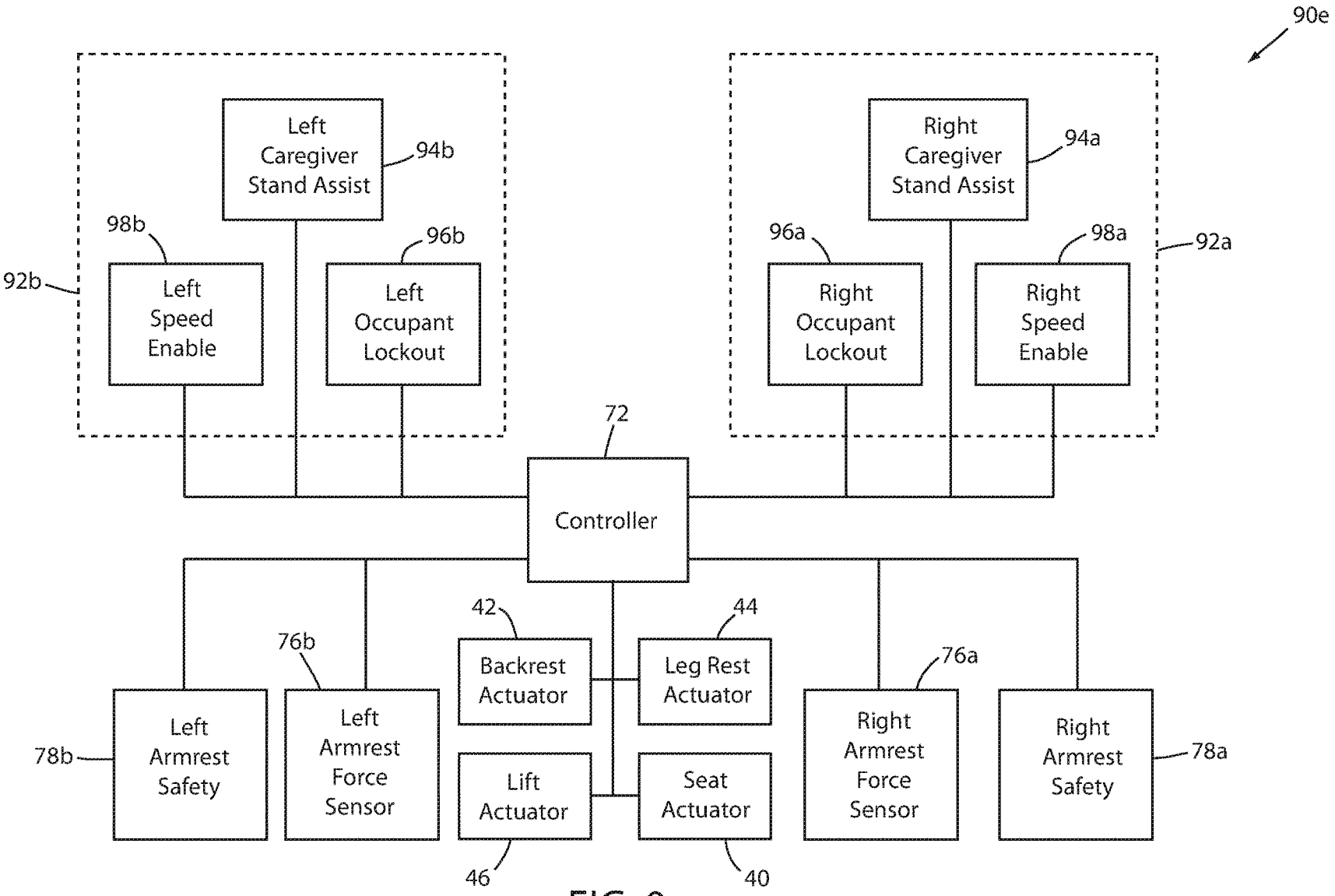
FIG. 9 is a block diagram of a fifth embodiment of a control system that is usable with the chair of FIG. 1.

FIG. 9 illustrates an alternative embodiment of a control system 90*e* that may be incorporated into chair 20 in lieu of control systems 90*a*, 90*b*, 90*c*, or 90*d*. Those elements of control system 90*e* that are the same as elements found in control systems 90*a*, 90*b*, 90*c*, and/or 90*d* are provided with the same reference number and, unless otherwise noted below, operate in the same manner as discussed above, and may be modified in any of the manners discussed above.

Control system 90*e* includes all of the same elements as control system 90*d* with the addition of a pair of speed enables 98*a* and 98*b* located on control panels 92*a* and 92*b*, respectively. Control system 90*e* controls chair 20 in the same manner as control system 90*d* (and any of its modifications) with the exception that, unlike control system 90*d*, control system 90*e* provides the caregiver with the option of allowing the occupant to control the speed or to not control the speed of chair 20. That is, when the caregiver activates one or both of speed enable controls 98*a* or 98*b*, control system 90*e* functions in the same manners as control system 90*d*, including its various modifications.

However, if the caregiver does not activate one of speed enable controls 98*a* or 98*b*, or deactivates a previously activated speed enable control 98*a* or 98*b*, then controller 72 moves chair 20 between configurations 32 and 34 at a speed that does not vary in response to occupant forces applied to force sensors 76*a* and/or 76*b*. Control system 90*e* therefore gives the caregiver the dual options of locking out the occupant's ability to transition between configurations 32 and 34 in the absence of the caregiver (via lockouts 96*a* and 96*b*) and choosing whether the speed of chair 20 will vary, or not, on the basis of the forces applied by the occupant's to sensors 76*a* and 76*b* (via speed enable controls 98*a* and 98*b*).

Figure 10:
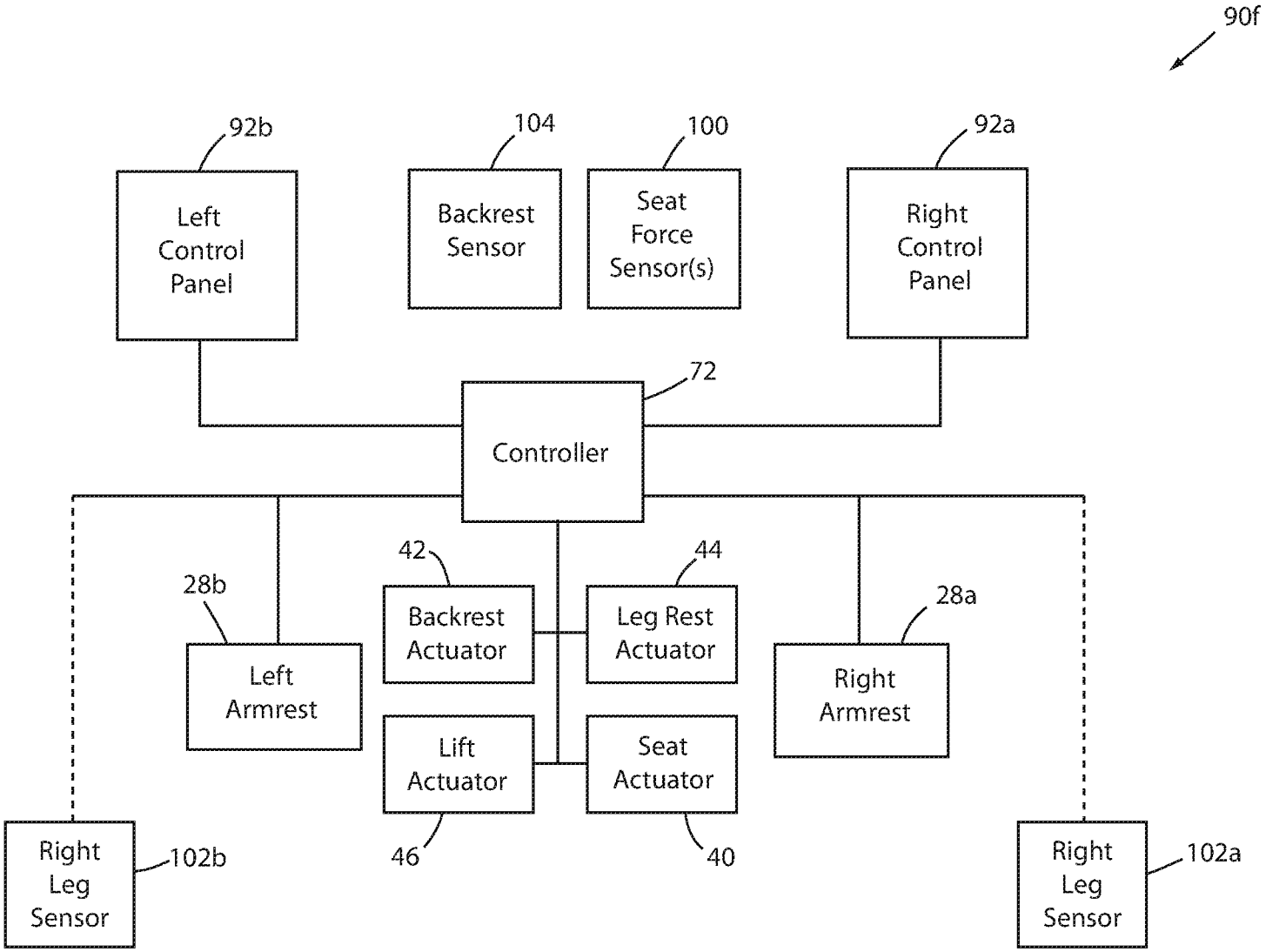
FIG. 10 is a block diagram of a sixth embodiment of a control system that is usable with the chair of FIG. 1.

FIG. 10 illustrates an alternative embodiment of a control system 90*f* that may be incorporated into chair 20 in lieu of control systems 90*a*, 90*b*, 90*c*, 90*d*, or 90*e*. Those elements of control system 90*f* that are the same as elements found in control systems 90*a*, 90*b*, 90*c*, 90*d*, and/or 90*e* are provided with the same reference number and, unless otherwise noted below, operate in the same manner as discussed above, and may be modified in any of the manners discussed above.

FIG. 10 illustrates control system 90*f* as including right and left control panels 92*a* and 92*b*, but does not indicate which specific controls (e.g. stand assist controls 94, lockout controls 96, and/or speed enable controls 98) are included on control panels 92*a* and 92*b*. This has been done to indicate that any one of these controls, or any combination of two or more of these controls, may be included on the control panels 92*a* and 92*b* when control system 90*f* is used on chair 20. Similarly, FIG. 10 illustrates control system 90*f* as including right and left armrests 28*a* and 28*b*, but does not indicate which specific sensors and/or switches armrests 28*a* and 28*b*, include (e.g. force sensors 76 or safety switches 78). This too has been done to indicate that either or both of these sensors/switches may be coupled to armrests 28 when control system 90*f* is used on chair 20.

Control system 90*f* differs from all of the previous control systems 90 discussed above in that control system 90*f* includes one or more of the following components: (1) one or more seat force sensors 100; (2) one or more leg sensors 102; and (3) one or more backrest sensors 104. The dashed lines of FIG. 10 indicate that any one or more of these components may be present when implementing control system 90*f* on chair 20. Controller 72 of control system 90*f* takes into account the outputs from at least one of these three components when controlling the movement of chair 20 between configurations 32 and 34. The control of chair 20's movement between configurations 32 and 34 is also based upon one or more of the inputs from control panels 92*a* or 92*b* and/or armrests 28*a* and 28*b*. Controller 72 uses these inputs in any of the same manners discussed above with respect to control systems 90*a*, 90*b*, 90*c*, 90*d*, and/or 90*e*.

In one embodiment of control system 90*f*, controller 72 controls the speed of chair 20 based upon inputs from one or more seat force sensors 100. When helping the occupant stand up, controller 72 uses the outputs from seat force sensors 100 to gauge how much of the occupant's weight has shifted from the seat 22 of chair 20 to either armrests 28 or to the legs of the occupant. When helping the occupant to sit down on chair 20, controller 72 uses the outputs from the seat force sensors 100 to gauge how much of the occupant's weight the occupant is exerting against seat 22 of chair 20 and/or to compare how much of the occupant's weight has shifted to the seat 22 from other sensed locations (e.g. armrests 28). Controller 72 it thus capable of determining a ratio of the seat forces with respect to the armrest forces and using the ratio for controlling the speed of chair 20.

In one such embodiment, seat force sensors 100 are implemented as load cells positioned underneath seat 22. Such load cell seat force sensors 100 may be constructed in the manner disclosed in commonly assigned U.S. patent application Ser. No. 62/268,549 filed Dec. 17, 2015 by inventors Anish Paul et al. and entitled PERSON SUPPORT APPARATUS WITH EXIT DETECTION SYSTEM, the complete disclosure of which has previously been incorporated herein by reference. Other manners of using load cells may alternatively be used. Still further, other types of seat force sensors 100 may be used.

In at least one embodiment of control system 90*f*, chair 20 includes at least two seat sensors: one positioned to detect forces applied generally toward front end 36 of seat 22 and another one positioned to detect forces applied generally toward back end 38 of seat 22. In this embodiment, controller 72 monitors the ratio of the occupant's weight on the back end 38 compared to the occupant's weight on the front end 36. Controller 72 uses this ratio, as well as the speed at which it changes, to control the speed of movement of chair 20 between the configurations 32 and 34. The speed of chair 20 is also controlled by controller 72 based upon, in at least one embodiment, the forces detected by force sensors 76*a* and 76*b*. In an alternative embodiment, controller 72 uses the ratio between the weight sensed on seat 22 and the weight sensed on armrests 28 to control the speed of movement of chair 20 between the configurations 32 and 34.

In some embodiments of chair 20, at least three seat sensors 100 are provided and used by controller 72 to compute the center of gravity of the occupant when positioned on seat 22. In this embodiment, controller 72 controls the speed of chair 20 based upon the movement of the occupant's center of gravity. If the occupant's center of gravity is not moving in the proper direction, or with enough speed, controller 72 may slow down the movement of chair 20 in order to allow the occupant time to adjust his or her weight. In one embodiment, the calculation of the occupant's center of gravity is carried out using load cells implemented into seat 22, which are processed according to the techniques disclosed in commonly assigned U.S. Pat. No. 5,276,432 issued to Travis and entitled PATIENT EXIT DETECTION MECHANISM FOR HOSPITAL BED, the complete disclosure of which is hereby incorporated herein by reference.

Leg sensors 102*a* and 102*b*, when included on chair 20, are adapted to detect the presence or absence of the occupant's legs from a position right in front of chair 20. Leg sensors 102*a* and 102*b* therefore may be any suitable proximity sensor, such as, but not limited to, ultrasound sensors, infrared sensors, capacitive sensors, or other types of sensors. In one embodiment, leg sensors 102*a* and 102*b* are fixedly attached to base 64 on either side of leg rest 26 so that leg rest 26 does not interfere with the sensing abilities of sensors 102*a* and 102*b*. Leg sensors 102*a* and 102*b* are adapted to detect if an occupant has his or her legs positioned sufficiently close to chair 20 to be able to safely transition either to a standing state or to a sitting state. In this regard, sensors 102*a* and 102*b* may detect whether the occupant's legs are positioned within a threshold number of inches or centimeters from the front end of chair 20.

In those embodiments of control system 90*f* where chair 20 includes at least one leg sensor 102, controller 72 controls movement of chair 20 between configurations 32 and 34 only when one or both of the leg sensors 102*a* and/or 102*b* sense the presence of the occupant's legs in front of chair 20. Leg sensors 102*a* and 102*b* therefore act as safety sensors that help ensure the occupant is not standing too far in front of chair 20 when attempting to sit on chair 20, and/or that help ensure that the occupant has not placed his or her feet on the ground too far in front of leg rest 26 to be able to stably support himself or herself after being lifted to the standing position by chair 20. If either leg sensor 102*a* or 102*b* does not detect the occupant's legs in the proper position, controller 72 does not allow movement of chair 20 between the configurations 32 and 34. Control panels 92*a* and 92*b*, however, may include an override switch for enabling the caregiver to transition chair 20 from one configuration to another when chair 20 is empty, or in other situations.

In those embodiments of control system 90*f* where chair 20 includes one or more backrest sensors 104, controller 72 controls a speed of the movement of chair 20 between configurations 32 and 34 based also upon the outputs of backrest sensor(s) 104. Thus, for example, if chair 20 is being moved from its seated configuration 32 to its standing configuration 34, and controller 72 determines that the occupant is still leaning back against backrest 24 (via the outputs of backrest sensor(s) 104), controller 72 moves chair 20 at a slower speed in order to allow the occupant time to shift his or her body forward in preparation for standing. Similarly, if chair 20 is being moved from its standing configuration 34 to its seated configuration 32, and controller 72 determines that the occupant has relatively little weight on backrest 24, controller 72 moves chair 20 at a slower speed in order give the occupant more time to lean back into backrest 24 gradually, rather than fall back forcefully.

From the foregoing discussion, it can be seen that, if control system 90*f* includes both seat force sensors 100 and backrest sensors 104, the speed at which controller 72 moves chair 20 between configurations 32 and 34 is affected by both a combination of sensors 100 and 104, as well as sensors 76.

In any of the control systems 90*a-f* described above, including their various modifications, it will be understood that the movement of chair 20 between configurations 32 and 34 may also be tied to one or more other sensor inputs and/or pieces of information. For example, in any of these embodiments, chair 20 may include a brake sensor for detecting whether or not a brake has been activated for braking wheels 30 or not. If the brake has not been activated, then controller 72 will not allow movement of chair 20 from seated configuration 32 to standing configuration 34, or vice versa. In some embodiments, chair 20 also includes sensor for detecting when armrests 28 have been pivoted to a stowed position. These sensors communicate with controller 72 and controller 72 prevents chair 20 from transitioning between configurations 32 and 34 if both armrests 28 are not in their use position (i.e. the position shown in FIGS. 1 and 2). In those embodiments having an exit detection system, controller 72 may be programmed to not move chair 20 to the standing configuration 32 whenever the exit detection system is armed.

It will also be understood that control panels 92*a* and 92*b* may include additional controls for controlling still other aspects of the movement of chair 20 between configurations 32 and 34. For example, in some embodiments, control panels 92*a* and 92*b* include a caregiver speed control that enables the caregiver to control and change the speed at which chair 20 moves when transitioning between configurations 32 and 34. In other embodiments, control panels 92*a* and 92*b* include a fixed speed control that allows the caregiver to move chair 20 between configurations 32 and 34 at a fixed speed, regardless of the outputs of any occupant force sensors or switches.

In sum, the various embodiments of chair 20 trigger movement between configurations 32 and 34 based upon signals from one or more sensors (e.g. armrest sensors, seat sensors, and/or backrest sensors) and/or control the speed of movement based upon signals from one or more of the various sensors. In some cases, the signals from one or more of the sensors are compared to the signals from one or more of the other sensors, such as by determining how much weight has shifted from one type of sensors (e.g. armrest, seat, or backrest) to another type of sensor (armrest, seat, or backrest), and this comparison is used for controlling the speed of movement. In other embodiments, the speed of movement is controlled based upon signals from only one of the three types of sensors (armrest, seat, or backrest).

Various additional alterations and changes beyond those already mentioned herein can be made to the above-described embodiments. This disclosure is presented for illustrative purposes and should not be interpreted as an exhaustive description of all embodiments or to limit the scope of the claims to the specific elements illustrated or described in connection with these embodiments. For example, and without limitation, any individual element(s) of the described embodiments may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Any reference to claim elements in the singular, for example, using the articles "a," "an," "the" or "said," is not to be construed as limiting the element to the singular.

What is claimed is:

1. A chair comprising:

a seat;

a left armrest and a right armrest;

an actuator system for tilting and lifting the seat such that the seat is movable between a seated configuration and a standing configuration;

a caregiver control panel positioned at a location on the chair that is accessible to a caregiver associated with an occupant of the chair, the caregiver control panel including a caregiver control adapted to be activated and deactivated by the caregiver;

an occupant control positioned at a location on the chair that is accessible to the occupant while the occupant is seated on the seat, the occupant control adapted to be activated and deactivated by the occupant of the chair;

a force sensor adapted to detect an amount of force applied by the occupant of the chair, the force sensor spaced away from the caregiver control panel and positioned at one of the seat, left armrest, or right armrest; and a controller in communication with the force sensor, the occupant control, and the caregiver control, the controller adapted to perform the following: (a) if both the caregiver control and the occupant control are activated, to vary a speed of the actuator system based upon the amount of the force detected by the force sensor while the actuator system is moving the chair between the seated configuration and the standing configuration; (b) if the caregiver control is activated but the occupant control is not activated, to not move the chair between the seated and standing configurations, and (c) if the caregiver control is deactivated, to not move the chair between the seated configuration and the standing configuration regardless of the amount of the force detected by the force sensor and regardless of the activation of the occupant control.

2. The chair of claim 1 wherein the force sensor is positioned at the seat such that at least a portion of the occupant's weight is detected by the force sensor when the seat is in the seated configuration and the chair is occupied by the occupant.

3. The chair of claim 1 further including a second force sensor adapted to detect a second amount of force applied by the occupant of the chair, the controller adapted to vary the speed of the actuator system based also upon the second amount of force detected by the second force sensor.

4. The chair of claim 3 wherein the second force sensor is positioned at an end of one of the right or left armrests.

5. The chair of claim 4 wherein the controller increases the speed of the actuator system in response to the second amount of force increasing as the seat moves from the seated configuration to the standing configuration, and decreases the speed of the actuator system in response to the second amount of force decreasing as the seat moves from the seated configuration to the standing configuration.

6. The chair of claim 1 further comprising:

a right force sensor adapted to detect a right force applied by the occupant to the right armrest;

a left force sensor adapted to detect a left force applied by the occupant to the left armrest; and wherein the controller is further adapted to vary the speed of the actuator system based upon a combination of a magnitude of the right force and a magnitude of the left force.

7. The chair of claim 6 wherein the occupant control comprises:

a right safety switch incorporated into the right armrest;

a left safety switch incorporated into the left armrest; and wherein the controller is further adapted to prevent movement of the seat from the seated configuration to the standing configuration, or vice versa, if at least one of the right and left safety switches is not activated, even if forces are detected by any of the force sensor, right force sensor, or left force sensor.

8. The chair of claim 7 wherein the right safety switch and right force sensor are positioned adjacent a front end of the right armrest, and the left safety switch and the left force sensor are positioned adjacent a front end of the left armrest.

9. The chair of claim 8 wherein the right safety switch and right force sensor are positioned close enough to each other to be able to be simultaneously activated by the occupant's right hand, and the left safety switch and left force sensors are positioned close enough to each other to be able to be simultaneously activated by the occupant's left hand.

10. The chair of claim 1 further comprising:

a pivotable backrest;

a backrest force sensor adapted to detect an amount of force exerted by the occupant against the backrest; and wherein the controller is further adapted to vary the speed of the actuator system based upon the amount of the force detected by the backrest force sensor.

11. The chair of claim 1 further comprising a second force sensor coupled to a pivotable backrest of the chair, the second force sensor being adapted to detect at least a portion of a force exerted by the occupant when he or she leans back against the backrest.

12. The chair of claim 1 further including a second force sensor adapted to detect a second amount of force applied by the occupant of the chair, wherein the controller is adapted to vary the speed of the actuator system based upon the second amount of force detected by the second force sensor, and wherein the force sensor and second force sensor are positioned at the seat such that at least a portion of the occupant's weight is detected by both the force sensor and the second force sensor when the chair is occupied by the occupant.

13. The chair of claim 12 wherein the controller varies the speed of the actuator system based upon a speed at which the occupant's weight shifts from one of the force sensor and the second force sensor to the other of the force sensor and the second force sensor.

14. The chair of claim 1 further comprising:

a right force sensor adapted to detect a right force applied by the occupant to the right armrest;

a left force sensor adapted to detect a left force applied by the occupant to the left armrest; and wherein the controller is further adapted to vary the speed of the actuator system when moving the seat from the seated configuration to the standing configuration based upon a speed at which the occupant's weight shifts from the force sensor to either or both of the right and left force sensors.

15. The chair of claim 1 further including a caregiver speed control separate from the caregiver control and positioned at a location accessible to a caregiver associated with the occupant of the chair, the controller in communication with the caregiver speed control and adapted to drive the actuator system at a variable speed dictated by the caregiver speed control, rather than the amount of the force detected by the force sensor, when the caregiver speed control is activated.

16. The chair of claim 1 further comprising:

a leg rest movable between an extended use position and retracted stowed position; and a backrest pivotable between an upright orientation and a substantially horizontal orientation.

17. The chair of claim 16 wherein the right and left armrests are pivotable between use positions and stowed positions, and wherein the controller is adapted to prevent movement of the seat from the seated configuration to the standing configuration, or vice versa, when at least one of the right and left armrests is pivoted to the stowed position.

18. A chair comprising:

a seat;

a right armrest;

a left armrest;

an actuator system for tilting and lifting the seat such that the seat is movable between a seated configuration and a standing configuration;

a caregiver control panel positioned at a location on the chair that is accessible to a caregiver associated with an occupant of the chair, the caregiver control panel including a caregiver control adapted to be activated and deactivated by the caregiver;

a plurality of force sensors adapted to detect a first amount of force exerted by the occupant on a front portion of the chair and a second amount of force exerted by the occupant on a back portion of the chair;

a right armrest sensor adapted to detect a presence of an occupant's right hand on the right armrest;

a left armrest sensor adapted to detect a presence of the occupant's left hand on the left armrest; and a controller adapted to prevent movement of the seat from the seated configuration to the standing configuration when the caregiver control is deactivated regardless of a presence of the occupant's right or left hand on the right or left armrest, respectively; the controller further adapted to prevent movement of the seat from the seated configuration to the standing configuration when at least one of the right and left armrest sensors does not detect the presence of the occupant's right or left hand on the right or left armrest, respectively, regardless of a ratio of the first amount of force to the second amount of force and regardless of the caregiver control being activated; the controller further adapted to drive the actuator system such that the seat is moved from the seated configuration to the standing configuration when the caregiver control is activated and the right and left armrest sensors detect the presence of the occupant's right and left hands on the right and left armrests, respectively, the controller adapted to drive the actuator system at a speed based upon the ratio of the first amount of force to the second amount of force.

19. The chair of claim 18 further comprising a proximity sensor adapted to detect the presence or absence of the occupant's legs within a range of a front of the chair, the controller adapted to prevent movement of the seat from the seated configuration to the standing configuration if the proximity sensor does not detect the occupant's legs within the range.

20. The chair of claim 18 further including an occupant control positioned at a location accessible to the occupant while the occupant is seated on the seat, the controller in communication with the occupant control and adapted to drive the actuator system such that the seat is moved from the seated configuration to the standing configuration when the occupant control is activated and the right and left armrest sensors detect the presence of the occupant's right and left hands on the right and left armrests, respectively.

* * * * *